United States Patent [19]

Latty

[11] Patent Number: 4,687,491

[45] Date of Patent: Aug. 18, 1987

[54] FUEL ADMIXTURE FOR A CATALYTIC COMBUSTOR

[75] Inventor: James A. Latty, San Juan Capistrano, Calif.

[73] Assignee: Dresser Industries, Inc., Dallas, Tex.

[21] Appl. No.: 583,078

[22] Filed: Feb. 23, 1984

Related U.S. Application Data

[63] Continuation-in-part of Ser. No. 530,155, Sep. 7, 1983, which is a continuation of Ser. No. 294,871, Aug. 21, 1981.

[51] Int. Cl.[4] ..... C10L 1/32

[52] U.S. Cl. ..... 44/51; 44/52; 44/56; 252/351; 122/4 D; 122/31 R; 431/4; 431/8

[58] Field of Search ..... 44/51, 53, 56, 52; 48/196 FM, 197 FM; 252/351; 431/4, 8; 122/4 D, 31 R

[56] References Cited

U.S. PATENT DOCUMENTS

| | | | |
|---|---|---|---|
| 2,259,010 | 10/1941 | Taylor | 60/45 |
| 2,624,172 | 1/1953 | Houdry | 60/39.04 |
| 3,223,166 | 12/1965 | Hunt et al. | 166/38 |
| 3,244,231 | 4/1966 | Grekel et al. | 166/38 |
| 3,322,195 | 5/1967 | Brown et al. | 166/38 |
| 3,352,652 | 11/1967 | Belfit | 166/59 |
| 3,420,300 | 1/1969 | Todd | 166/38 |

(List continued on next page.)

FOREIGN PATENT DOCUMENTS

| | | | |
|---|---|---|---|
| 0212276 | 9/1958 | Australia | 122/4 D |
| 0021471 | 7/1981 | European Pat. Off. | 44/51 |
| 2112447 | 9/1972 | Fed. Rep. of Germany . | |
| WO80/00025-89 | 11/1980 | PCT Int'l Appl. | 44/51 |
| 0969051 | 9/1964 | United Kingdom | 44/51 |
| 1509901 | 5/1978 | United Kingdom | 44/51 |
| 0068942 | 3/1947 | U.S.S.R. . | |

OTHER PUBLICATIONS

Loury, H. H. *Chemistry of Coal Utilization,* Supplementary vol, 1963, pp. 892–894, John Wiley & Sons, Inc., New York.

Western States Section "The Combustion Institute" 1980, Spring Meeting, 21–22, Apr. 1980.

The WAO Boiler for Enhanced Oil Recovery, S. G. Balog, Manager Reservoir Engineering, R. K. Kerr, Supervisor, R&D, Alberta Energy Co. Ltd.

*Primary Examiner*—William R. Dixon, Jr.
*Assistant Examiner*—Margaret B. Medley
*Attorney, Agent, or Firm*—William R. Peoples

[57] ABSTRACT

Disclosed is a catalytic combustor and systems for the boilerless stoichiometric production of a working fluid such as steam from a burn-mixture comprised of a carbonaceous fuel and a diluent. In a preferred burn-mixture, the diluent includes a first portion taken from an emulsion of the fuel and water mixed in a thermally self-extinguishing mass ratio, and a second portion taken in an amount from combustion products of a mixture previously combusted to heat the resulting burn-mixture so it combusts in the presence of a catalyst at an adiabatic flame temperature between upper and lower stability limits of the catalyst. Production of the steam is by a controlled substantially stoichiometric process utilizing a combustor to provide steam over a wide range of heat release rates, temperatures and pressures for steam flooding an oil bearing formation. Even though formation characteristics change during a steam flooding operation, output steam of the combustor may be kept at a constant heat release rate by dividing the total amount of water passing through combustor between a first portion which is included in the fuel-mixture and a second portion which is injected into the heated products of combustion. In this way, the linear velocity of the fluid stream passing through the combustor catalyst may be kept within operational limits of the catalyst while maintaining stoichiometric combustion. When necessary, preheating of at least one of the components of the mixture burned in the catalyst is provided by a portion of the heat of combustion.

17 Claims, 18 Drawing Figures

U.S. PATENT DOCUMENTS

| | | | |
|---|---|---|---|
| 4,388,892 | 6/1981 | Rody | 122/4 D |
| 4,397,356 | 8/1983 | Retallick | 122/4 D |
| 3,456,721 | 7/1969 | Smith | 166/59 |
| 3,804,163 | 4/1974 | Bradley et al. | 166/59 |
| 3,817,332 | 6/1974 | Berry et al. | 166/302 |
| 3,914,090 | 10/1975 | Pfefferle | 431/9 |
| 3,938,933 | 2/1976 | Armas | 431/4 |
| 3,958,915 | 5/1976 | Noda et al. | 431/9 |
| 3,982,591 | 9/1976 | Hamrick et al. | 166/302 |
| 4,053,015 | 10/1977 | Hamrick et al. | 166/302 |
| 4,069,005 | 1/1978 | Palani | 431/4 |
| 4,133,847 | 1/1979 | Feuerman | 44/51 |
| 4,151,259 | 4/1979 | Hollingsworth | 423/167 |
| 4,173,455 | 11/1979 | Foder et al. | 44/51 |
| 4,204,829 | 5/1980 | Kendall | 431/7 |
| 4,237,973 | 12/1980 | Todd | 166/302 |
| 4,241,722 | 12/1980 | Dickinson | 126/263 |
| 4,335,684 | 6/1982 | Davis | 123/1 A |

FIG. 12
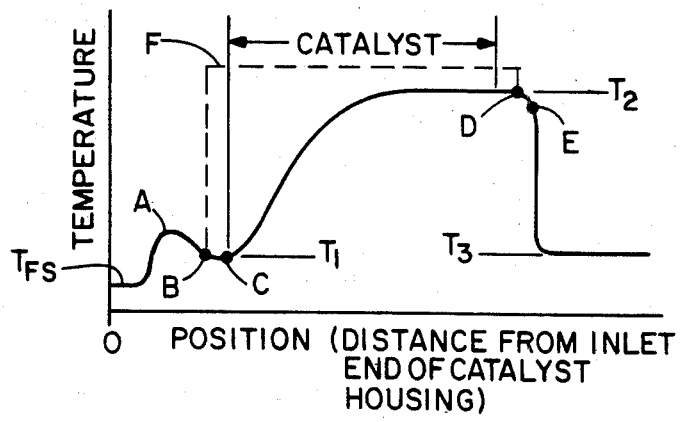
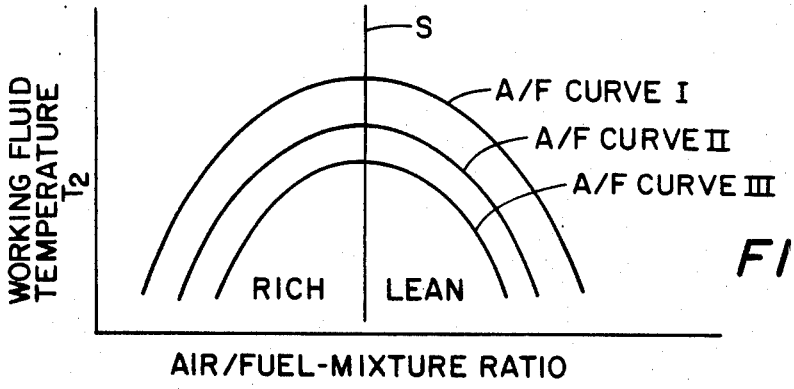
FIG. 13
FIG. 14
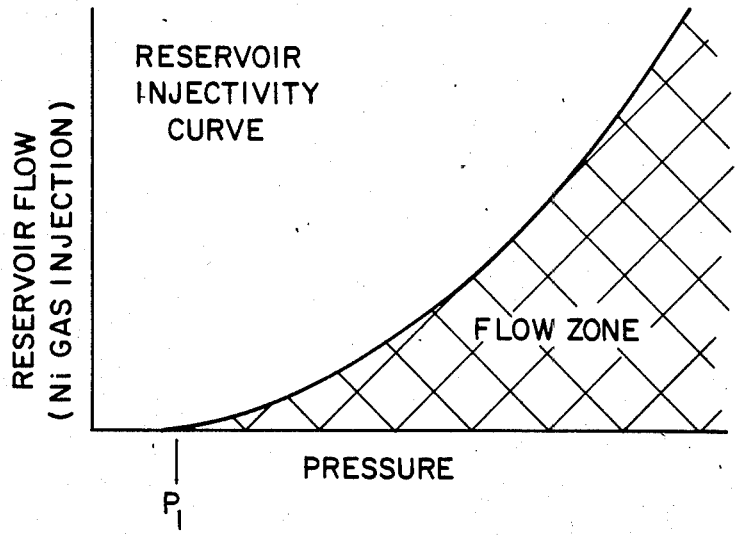

FUEL ADMIXTURE FOR A CATALYTIC COMBUSTOR

This application is a continuation-in-part of application Ser. No. 530,155 filed Sept. 7, 1983, which is a continuation of application Ser. No. 294,871 filed Aug. 21, 1981.

TECHNICAL FIELD

The present invention relates to a system, apparatus, fuel and method utilized in producing a heated working fluid such as steam.

BACKGROUND ART

One prior art patent disclosing a catalytic combustor such as may be used in the production of steam for enhanced oil recovery is U.S. Pat. No. 4,237,973. Another combustor which may be used to produce steam downhole includes U.S. Pat. No. 3,456,721. One method of start-up for a downhole combustor is disclosed in U.S. Pat. No. 4,053,015 relating to the use of a start fuel plug. Some characteristics of fuels used in combustors are mentioned in U.S. Pat. No. 3,420,300 and the injection of water to cool products of combustion are disclosed in U.S. Pat. No. 3,980,137. Another United States patent which may be of interest is No. 3,223,166.

Definitions—unless indicated otherwise, the following definitions apply to their respective terms wherever used herein:

- adiabatic combustion temperature—the highest possible combustion temperature obtained under the conditions that the burning occurs in an adiabatic vessel, that it is complete, and that dissociation does not occur.
- admixture—the formulated product of mixing two or more discrete substances.
- air—any gas mixture which includes oxygen.
- combustion—the burning of gas, liquid or solid in which the fuel is oxidizing, evolving heat and often light.
- combustion temperature—the temperature at which burning occurs under a given set of conditions, and which may not be necessarily stoichiometric or adiabatic.
- instantaneous ignition temperature—that temperature at which, under standard pressure and with stoichiometric quantities of air, combustion of a fuel will occur substantially instantaneously.
- oxidant—any fluid containing oxygen, such as air, hydrogen peroxide or oxygen gas.
- spontaneous ignition temperature—the lowest possible temperature at which combustion of a fuel will occur given sufficient time in an adiabatic vessel at standard pressure and with oxygen present.
- theoretical adiabatic flame temperature—the adiabatic flame temperature of a mixture containing fuel when combusted with a stoichiometric quantity of oxygen from atmospheric air when the mixture and atmospheric air are supplied at standard temperature and pressure.

DISCLOSURE OF INVENTION

The present invention contemplates a new and improved boilerless steam generating process and a system including a combustor for carrying out the process whereby carbonaceous fuel, water and substantially stoichiometric quantities of air, at least in part, form a burn-mixture which may be combusted catalytically to produce steam by utilizing the heat of combustion to heat the water directly. Generally, invention herein lies not only in the aforementioned process and system but also in the proportional combination of a diluent and a fuel together to form the burn-mixture which is fed into a catalytic combustor for combustion. Herein, the burn-mixture is comprised of a fuel-mixture and a diluent admixed at an specified mass ratio and temperature. More specifically, the fuel mixture is mixed in a thermally self-extinguishing mass ratio with water, in that, the ratio of water to fuel is such that the theoretical adiabatic flame temperature for the mixture is below that temperature necessary to support a stable flame in a conventional thermal combustor.

Water is, of course, well known as a useful working fluid due at least in part to its high heat capacity and the fact that it passes through a phase change from a liquid to a gas at relatively normal temperatures. The present invention in its broadest sense, however, should not be considered as being limited to the production of steam as a working fluid. Virtually, any non-combustible diluent having a high heat capacity may be mixed with the fuel to produce a suitable working fluid. For example, carbon dioxide, nitrogen, sulfur dioxide or combinations thereof, including water, may be used as the diluent under some circumstances while still practicing the present invention.

More particularly, the present invention resides in the use of a catalyst as the primary combustion means in a combustor for low temperature, stoichiometric combustion of a carbonaceous fuel to directly heat a quantity of water proportionally divided in first and second amounts which are added selectively (1) to the fuel prior to catalytic combustion to form a controlled fuel-mixture to control combustion temperature in the catalyst and the linear velocity of the fluids passing over the catalyst for combustion purposes, and (2) to the highly heated fluid exiting the catalyst to cool such fluid prior to exiting the combustor and thereby control the temperature of the heated working fluid produced by the combustor.

In addition to the foregoing, invention also resides in the novel manner of controlling the combustor for the burn-mixture to combust stably at temperatures considerably below the normal combustion temperature for the fuel even though the burn-mixture includes substantially stoichiometric quantities of carbonaceous fuel and air. Several advantages result from such low temperature, stoichiometric combustion particularly in that, the products of combustion are not highly chemically active, the formation of oxides of nitrogen is avoided, virtually all the oxygen in the air is used and soot formation is kept remarkably low.

Still further invention resides in the novel manner in which the combustor is started and shut down, particularly during start-up, in the control and mixing of fuel to assure that a light-off temperature is attained for the catalyst in the combustor before introducing the steam-generating burn-mixture, and during shut down to keep the catalyst from becoming wetted.

Another novel aspect of the present invention lies in the construction of the combustor so as to catalytically combust the thermally self-extinguishing fuel-mixture and, perhaps more generally, in the discovery that an emulsified fuel-mixture comprising water to fuel mass ratios generally in the range of 1.5:1 to 5.5:1 may be combusted with substantially stoichiometric quantities of oxidant to produce a useful working fluid. Advantageously, the exemplary combustor provides for simple, efficient and clean combustion of heavy hydrocarbon fuels.

Another important aim of the present invention is to provide a combustor and operating system therefor and a method of operating the same to enable the production of steam at different pressures, temperatures and rates of flow, which are somewhat independent of each other within limits, so that a single combustor can be used for example in enhanced oil recovery to treat oil bearing formations having widely different flow characteristics, the combustor being usable on each such formation to maximize the production of oil from the formation while minimizing the consumption of energy during such production.

The present invention also contemplates a unique system for preheating either the air or the fuel-mixture or both prior to entry into the combustor with heat generated by the combustion occurring in the combustor.

Novel controls also are provided for regulating the temperature of the steam produced by the combustor to be within a specified low range of temperatures within which the catalyst is capable of functioning to produce steam, that is, for example between the light-off temperature of the catalyst and the temperature for its upper limit of stability. Additionally, controls and means are provided for injecting water into the steam produced by combustion over the catalyst to cool the steam and convert further amounts of water into steam.

More particularly, the present invention contemplates a novel manner of controlling the catalytic combustor to produce steam over a wide range of different temperatures, pressures and heat release rates such as may be desired to match the combustor output to the end use contemplated. Thus, for example, a desired change in the heat release rate of the combustor may be achieved by changing the rate of flow of carbonaceous fuel through the combustor and making corresponding proportional changes in the flow rate of the oxidant or air necessary for substantially stoichiometric combustion, and the total quantity of water passing through the combustor to produce the steam. Advantageously, extension of the operating range of the combustor may be achieved by making use of the range of operating temperatures of the catalyst and linear velocities at which the burn-mixture may be passed through the catalyst while still maintaining substantially complete combustion of the burn-mixture. This may be accomplished by adjusting the proportion of the water in the fuel-mixture (the combustion water) and making a complimentary change in the proportion of injection water so as to operate the catalyst within an acceptable range of linear velocities with the discharge temperature of the steam exiting the combustor being kept at substantially the same level as before the adjustment. In this way, the heat release rate may be changed without a corresponding change in the discharge temperature all the while keeping the linear velocity of the burn-mixture through the catalyst within an acceptable range for stable operation of the combustor.

These and other features and advantages of the present invention will become more apparent from the following description of the best modes of carrying out the invention when considered in conjunction with the accompanying drawings.

BRIEF DESCRIPTION OF DRAWINGS

FIGS. 12 and 13 are graphs useful in understanding the operation and control of the exemplary systems.

FIG. 14 is a representative injectivity curve for pressurized injection of nitrogen gas into a formation bearing heavy oil.

BEST MODES FOR CARRYING OUT THE INVENTION

THE APPARATUS

Figure 1:
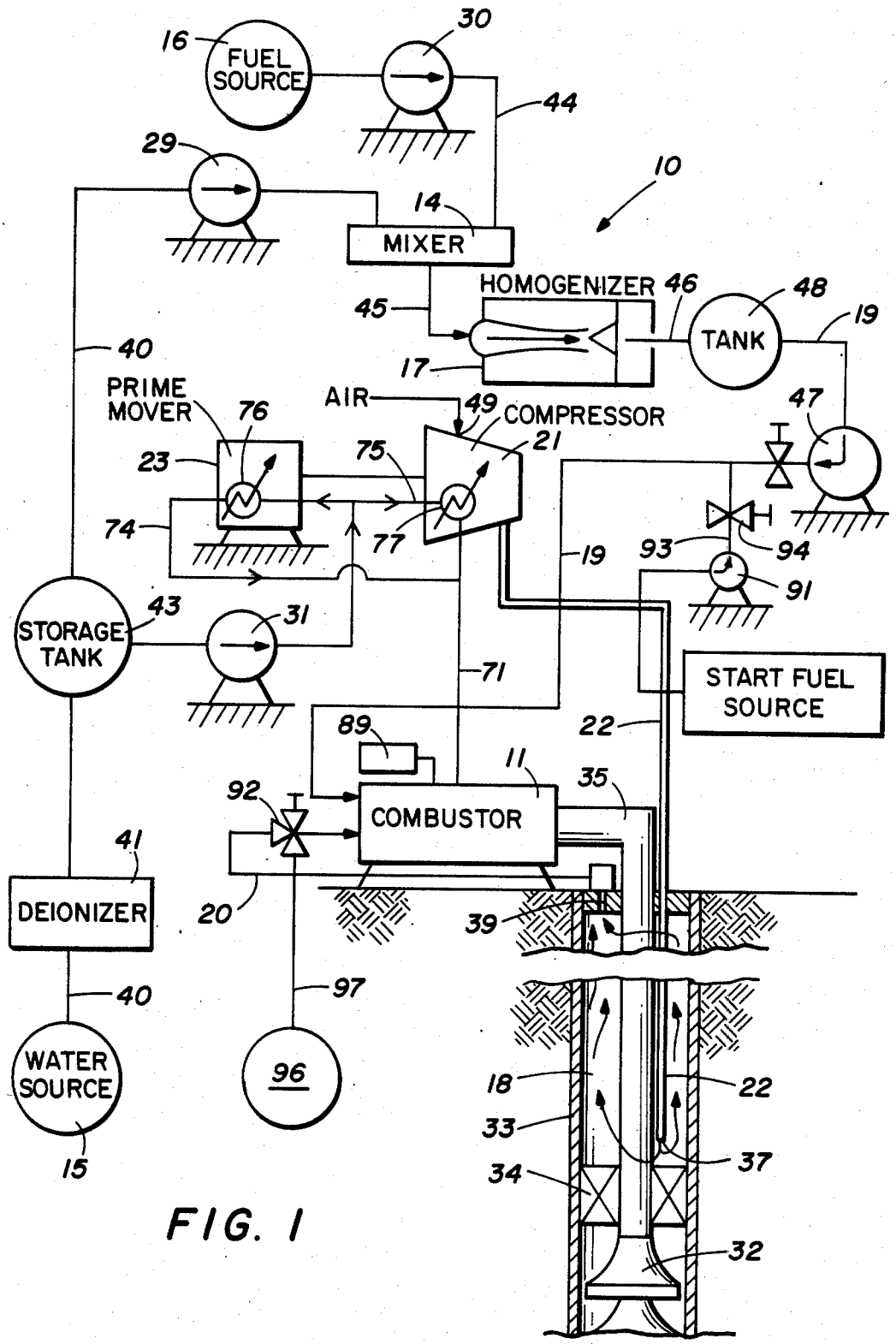
FIG. 1 is a schematic diagram of one embodiment of a steam generating system embodying the novel features of the present invention.

As shown in the drawings for purposes of illustration, the present invention is embodied in a boilerless steam generator such as may be used in the petroleum industry for enhanced oil recovery. It will be appreciated, however, the present invention is not limited to use in the production of steam for enhanced oil recovery, but may be utilized in virtually any set of circumstances wherein when it may be desirable to heat a fluid by combustion of a fuel such as in making a heated working fluid or in the processing of a fluid for other purposes. In the production of steam or any other heated working fluid, it is desirable to be both mechanically and thermally efficient to enable the greatest amount of work to be recovered at the least cost. It also is desirable that in the process of producing the working fluid damage to the environment be avoided.

The present invention contemplates a unique burn-mixture and a novel combustion system 10 including a new combustor 11, all providing for more efficient pollution-free production of a heated working fluid at relatively low combustion temperatures. For these purposes, the burn-mixture is catalytically combusted in a novelly controlled manner in the combustor to produce the working fluid. Specifically, the burn-mixture contemplated herein is formed from a unique fuel-mixture which is an admixture comprised of a diluent, such as water, and a carbonaceous fuel mixed in a thermally self-extinguishing mass ratio. The amount of water in this fuel-mixture is dependent, at least in part, upon the heat content of the fuel portion of the fuel-mixture to regulate the temperature of combustion of the burn-mixture when burnt in a catalytic combustion zone 13 (see FIG. 2) in the combustor 11. Specifically, the combustion temperature is kept within a predesignated low temperature range. Control also is provided to assure the delivery of substantially stoichiometric quantities of oxidant to the catalyst for mixing with the fuel-mixture to form a burn-mixture which passes over a catalyst 12 in te combustion zone 13. Advantageously, the high ratio of diluent to fuel in the burn-mixture keeps the theoretical adiabatic flame temperature of the mixture low so that the combustion temperature also is low thereby avoiding the formation of thermal nitrous oxides and catalyst stability problems otherwise associated with high temperature combustion at stoichiometric air/fuel ratios. Additionally, catalytic combustion of the burn-mixture avoids soot and carbon monoxide problems normally associated with thermal combustion and, by combusting the fuel substantially stoichiometrically, lower power is required to deliver oxidant to the combustor. Moreover, the working fluid produced in this manner is virtually oxygen free and thus is less corrosive than thermal combustion products.

Figure 3:
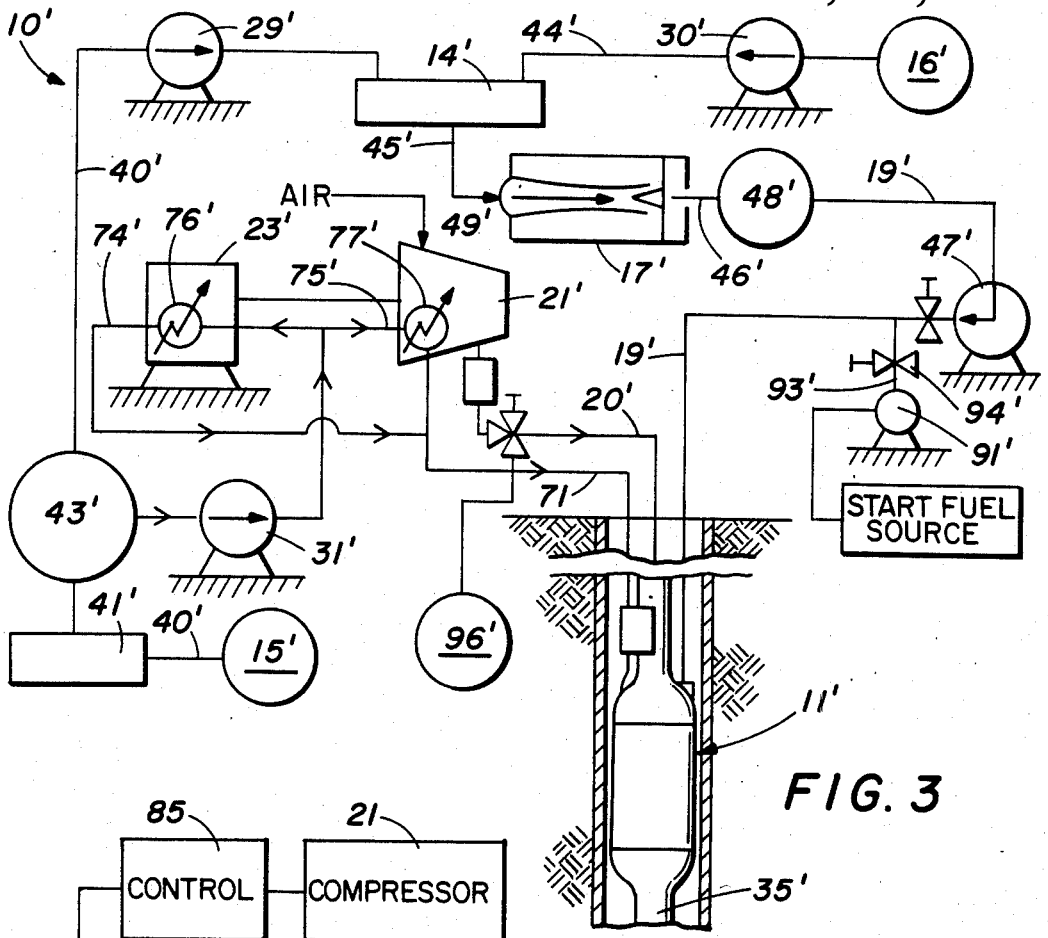
FIG. 3 is an alternative embodiment of a steam generating system embodying the novel features of the present invention.
Figure 4:
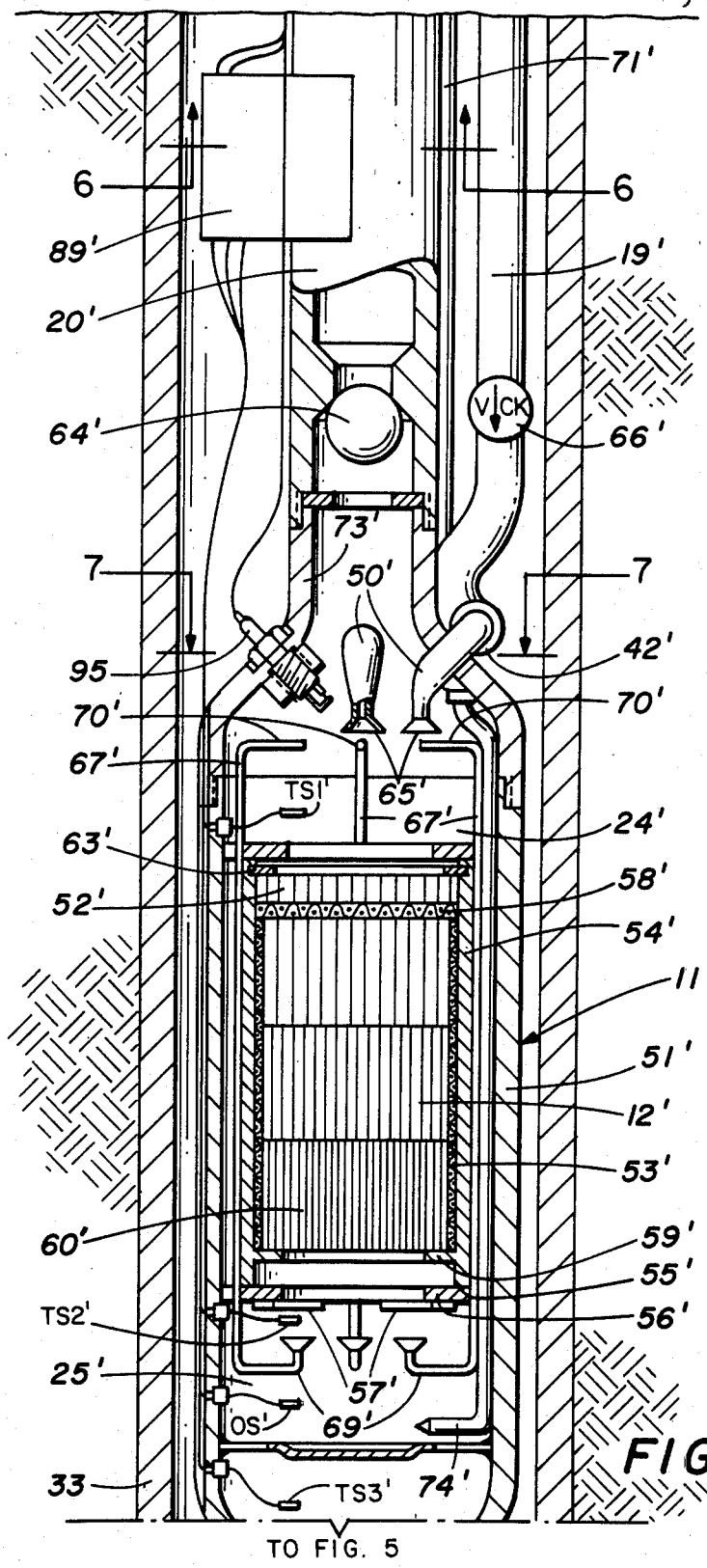
FIGS. 4 and 5 comprise a combined cross-sectional view of the combustor utilized in the alternative system shown in FIG. 3.

Two exemplary embodiments of the present invention are disclosed herein and both are related to the use of steam for enhanced oil recovery. The first embodiment (FIGS. 1 and 2) to be described contemplates location of the combustor 10 on the earth's surface such as at the head of a well to be treated. Although the system of this first embodiment illustrates treatment of only one well the system could be adapted easily to a centralized system connected to treat multiple wells simultaneously. A second embodiment contemplated for downhole use is shown in FIGS. 3 and 4 with parts corresponding to those described in the first embodiment identified by the same but primed reference numbers. The fuel and burn-mixtures and controls for the two different embodiments are virtually identical. Accordingly, the description which follows will be limited primarily to only one version for purposes of brevity with differences between the two systems identified as may be appropriate, it being appreciated that the basic description relating to similar components in the two systems is the same. As shown in FIG. 1, the first embodiment of the system contemplated by the present invention includes a mixer 14 wherein water from a source 15 and fuel oil from a source 16 are mechanically mixed in a calculated mass ratio for delivery to a homogenizer 17. The homogenizer forms the fuel-mixture as an emulsion for delivery through a line 19 to the combustor 11 for combustion. Air containing stoichiometric quantities of oxygen is delivered through another line 20 to the combustor 11 by means of a compressor 21 driven by a prime mover 23. Within the combustor (see FIG. 2), the emulsified fuel-mixture and air are mixed intimately together in an inlet chamber 24 to form the burn-mixture before flowing into the combustion zone 13 of the combustor. In the presence of the catalyst 12, the carbonaceous fuel contained within the burn-mixture is combusted directly heating the water therein to form a heated fluid comprised of super heated steam and the products of such combustion. Upon passing from the catalyst the heated fluid flows into a discharge chamber 25 wherein additional water from the source 15 is injected into the fluid to cool it prior to exiting the combustor. From the discharge chamber, the heated working fluid (steam) exits the combustor through an outlet 26 connected with tubing 35 leading into the well. Downhole, a packer 34 seals between the tubing and the interior of the well casing 33 and the tubing extends through the packer to a nozzle 32 particularly designed for directing the steam outwardly into an oil bearing formation through perforations in the casing.

Herein, the nozzle comprises a series of stacked frusto conical sections **32*a* held together by angularly spaced ribs 32*b*. Preferably, the space between the walls of adjacent sections are shaped as diffuser areas to recover at least some of the dynamic pressure in the steam so as to help in overcoming the natural formation pressure which resists the flow of steam into the formation. In the embodiment illustrated in FIG. 1, in order to recover some of the heat that might otherwise be lost by radiation from the tubing string 35 to the well casing 33, inlet air to the combustor 11 through the line 20 is circulated from the compressor 21 through the annulus 18 surrounding the tubing string above the packer 34 to preheat the air somewhat before entering the combustor. At the top of the casing, an outlet line 22 from the compressor extends into the well through the well head with an open lower end 37 of the line located just above the packer 34. Air from the compressor exits the lower end 37 of the line and flows upwardly within the annulus 18 to exit the well through an upper outlet opening 39 at the well head connecting with the inlet line 20 to the combustor. In the downhole version of the present invention, the combustor 11' (see FIGS. 3 and 4) the compressor outlet line 20' connects at the well head to the upper end of tubing string 35' with the combustor 11' being connected to the lower end of the tubing string just above the packer 34'**.

Figure 8:
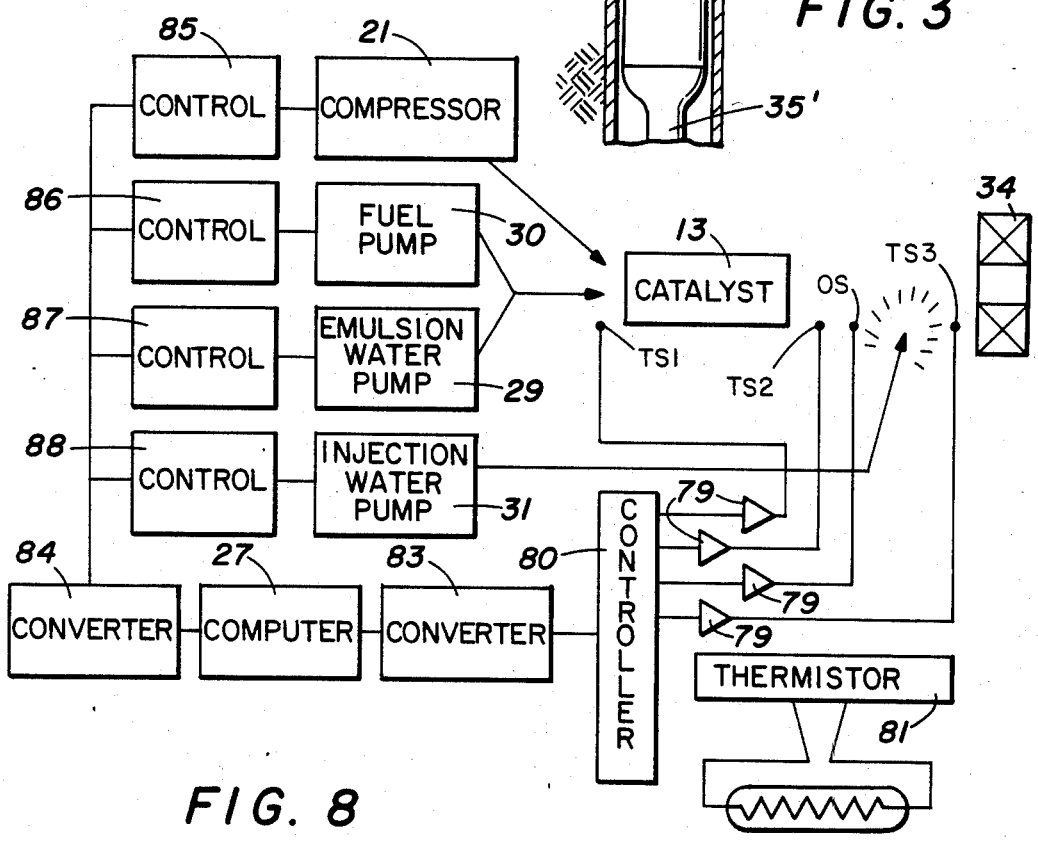
FIG. 8 is a schematic diagram of the controls utilized in the exemplary systems.

For controlling both the ratio of water to fuel in the fuel-mixture and the ratio of fuel-mixture and air relative to stoichiometric, control sensors (FIG. 2) including temperature sensors TS1, TS2 and TS3 and an oxygen sensor OS are provided in the combustor 11. Temperature sensor TS1, TS2 and TS3 are located in the inlet chamber 24, in the discharge chamber 25 ahead of the post injection water, and in the discharge chamber 25 beneath the post injection water, respectively, while the oxygen sensor OS is located in the discharge chamber. A schematic of this arrangement is shown in FIG. 8 wherein signals from the control sensors are processed in a computer 27 and latter is used to control the amount of air delivered by the compressor 21 to the combustor, pumps 29 and 30 in delivering relative quantities of water and fuel to the homogenizer 17 and the amount of water delivered by the post injection water pump 31.

As previously mentioned, several significant advantages are attained by combusting in accordance with the present invention. High thermal efficiency is attained, mechanical efficiency of system components is increased and virtually pollution free production of steam is accomplished at low combustion temperatures all with a fuel-mixture which does not combust thermally under normal conditions. Moreover, use of the fuel-mixture results in a boilerless production of steam by directly heating the water in the mixture with the heat generated by the combustion of the fuel in the mixture. Herein, one fuel-mixture contemplated comprises a mass ratio of water to fuel of 5.2:1 for deionized water and number two fuel oil. With this fuel-mixture and stoichiometric quantities of air passing over the catalyst 12, catalytic combustion of the fuel will produce an adiabatic flame temperature of approximately 1700° F. without the application of preheat from an external source. Other carbonaceous fuels which may be used in producing an acceptable fuel-mixture advantageously include those highly viscous oils which otherwise have only limited use as combustion fuels. In one early test, a topped crude oil, specifically Kern River heavy fuel oil, of approximately 13° API was formed as an emulsion with water and was combusted catalytically to directly heat the water in the emulsion ultimately to produce steam at a temperature of 1690° F. with a carbon conversion efficiency of 99.7%. In that test, the mass ratio of water produced in the form of steam, including the products of combustion, to fuel combusted was 14:1.

Although perhaps steam may be the most desirable working fluid produced by combustion in accordance with the present invention it will be appreciated that the inventive concept herein extends to the direct heating of a diluent as a result of combustion of a carbonaceous fuel mixed intimately with the diluent. The characteristics of the diluent that are important are, that the diluent have a high heat capacity, that it be a non-combustible, that it be useful in performing work, and that it give the burn-mixture a theoretical adiabatic flame temperature which is below the upper temperature stability limit of the catalyst. The latter is of course important to keep the catalyst or its support from being sintered, melted or vaporized as a result of the heat generated during combustion of the fuel portion of the burn-mixture. Having a high heat capacity is important from the standpoint of thermal efficiency in that relatively more heat is required to raise the temperature of the diluent one degree over other substances of equal mass. Herein, any capacity generally like that of nitrogen gas or above may be considered as being a "high heat capacity". Additionally, it is desirable that the diluent be able to utilize the heat of combustion to go through a phase change. With most of these characteristics in mind, other chemical moieties that may be acceptable diluents include water and carbon dioxide.

In selecting the mass ratio of diluent to fuel in the burn-mixture, both the heat of combustion of the fuel and the upper and lower temperature stability limits of the catalyst 12 are taken into consideration. The lower stability limit of the catalyst, herein is that low temperature at which the catalyst still efficiently causes the fuel to combust. Accordingly, for each type of catalyst that may be suitable for use in the exemplary combustor 11, some acceptable range of temperatures exists for efficient combustion of the fuel without causing damage to the catalyst. A selected temperature within this range then represents the theoretical adiabatic flame temperature for the burn-mixture. Specifically, the ratio of the diluent, or water as is contemplated in the preferred embodiment, to fuel is set by the heat of combustion (that amount of heat which theoretically is released by combusting the fuel) and is such that the amount of heat released is that which is necessary to heat up both the diluent and the products of combustion to the aforementioned selected temperature. This temperature, of course, is selected to maximize the performance of useful work by the working fluid produced from the combustor 11 given the conditions under which the working fluid must operate.

The system for providing the fuel-mixture to the combustor 11 is shown schematically in FIG. 1 with a schematic representation of the controls utilized in regulating the mass ratio of the fuel-mixture shown in FIG. 8. While the system shown in FIGS. 1 and 8 illustrates the various components thereof as being connected directly to each other, it should be recognized that the functions performed by some of the components may be performed at a site remote from the combustor 11.

More particularly, the water source 15 of the exemplary system 10 is connected by a line 40 to a deionizer 41 for removing impurities from the water which may otherwise foul or blind the catalyst 12. From the deionizer, the line 40 connects with a storage tank 43 from which the deionized water may be drawn by pumps 29 and 31 for delivery ultimately to the combustor 11. The pump 29 connects directly with the mixer 14 through the line 40 and a branch line 44 connects the mixer with the fuel pump 30 for the mixer to receive fuel from the fuel source 16. The deionized water and fuel are delivered to the mixer 14 in relative quantities forming an admixture whose proportions are equal to the aforementioned thermally self-extinguishing mass ratio. At the mixer, the two liquids are stirred together for delivery through an outlet line 45 to the homogenizer 17 where the two liquids are mixed intimately together as an emulsion to complete the mixing process. From the homogenizer, the admixture emulsion is transferred to an intermediate storage tank 48 through a line 46 and a pump 47 connecting with the latter tank provides the means by which the emulsion or fuel-mixture may be delivered in controlled volume through the line 19 connecting with the combustor 11.

While the preferred embodiment of the present invention contemplates a system 10 in which the fuel-mixture is formed as an emulsion which is fed without substantial delay to the combustor 11 for combusting the fuel in the mixture, in instances where greater stability in the emulsion may be desired, various chemical stabilizing agents including one or more nonionic surfactants and a linking agent, if desired, may be used to keep the emulsion from separating. In the aforementioned Kern River heavy fuel oil, the surfactants "NEODOL 91-2.5" and "NEODOL 23-6.5" manufactured by Shell Oil Company were utilized with butylcarbitol. In other instances, with suitable nozzles in the inlet chamber 24 of the combustor 11, the water and fuel may be sprayed from the nozzles in a manner sufficient to provide for adequate mixing of the water, fuel and air for proper operation of the catalyst 12. With this latter type of arrangement, the need for the homogenizer 17 may be avoided.

For combustion of the fuel-mixture in the combustor 11, oxygen is provided by air delivered by the compressor 21 to the combustor 11 through the line 20. Specifically, the compressor draws in air from the atmosphere through an inlet 49 and pumps higher pressure air to the combustor through the line 22, the annulus 18 and the line 20 to the combustor. At the combustor the line 20 connects to the inlet chamber 24 through the housing 51 and the fuel-mixture is delivered through line 19. The latter connects with the housing through an intake manifold 42 (see FIG. 2) which in turn communicates with the inlet chamber 24 through openings 50 in the combustor housing 51. Upstream of the manifold 42 within the line 19, a pressure check valve 66 is utilized to keep emulsion from draining into the catalyst before operational pressure levels are achieved. Similarly, a check valve 64 is located in the line 20 to keep air from flowing into the inlet chamber 24 before operational pressure levels are achieved. Within the inlet chamber 24, a fuel-mixture spray nozzle 65 is fixed to the inside of housing around each of the openings 50 and, through these nozzles, the emulsion is sprayed into the inlet chamber 24 for the fuel-mixture to be mixed thoroughly with the air to form the burn-mixture. The burn-mixture then flows through a ceramic heat shield 52. Following the heat shield is a nichrome heating element 58 for initiating combustion of a start-fuel mixture in the well head system. In the downhole version, the burn-mixture also flows past an electrical starter element 95 (see FIGS. 40 and 41) before flowing through the catalyst 12 for combustion of the fuel. In both the surface generator and the downhole generator, the catalyst 12 is a graded cell monolith comprised of platinum with rhodium on alumina layered on a magnesium aluminum titanate support and operates at a temperature below the theoretical adiabatic flame temperature for number two diesel fuel.

Figure 2:
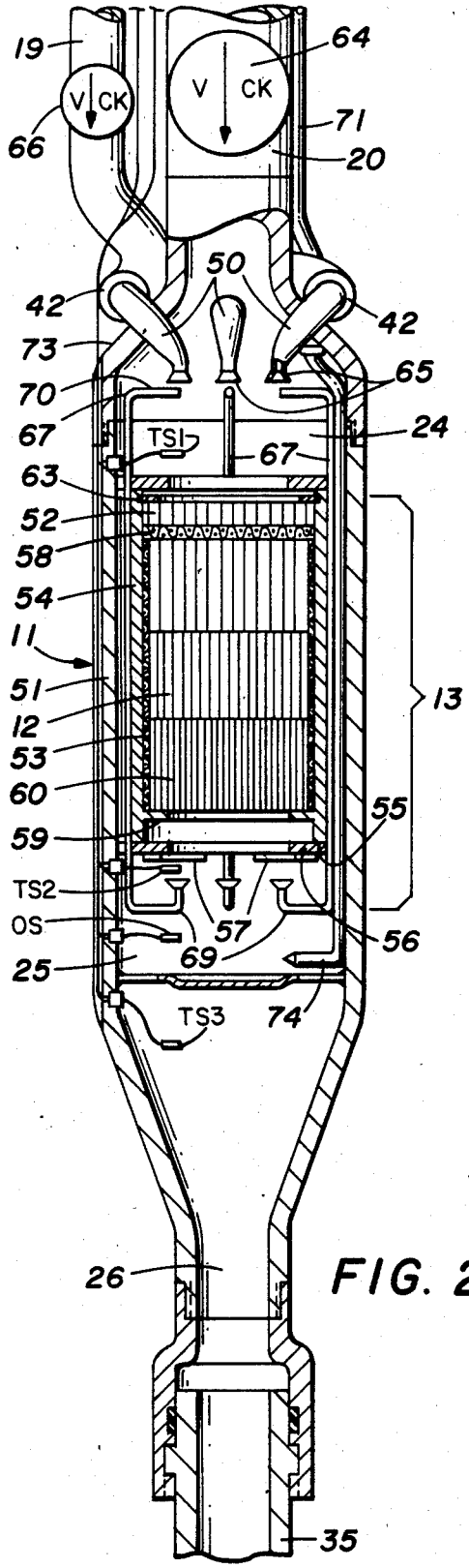
FIG. 2 is a cross-sectional view of the combustor utilized in the exemplary system shown in FIG. 1.
Figure 6:
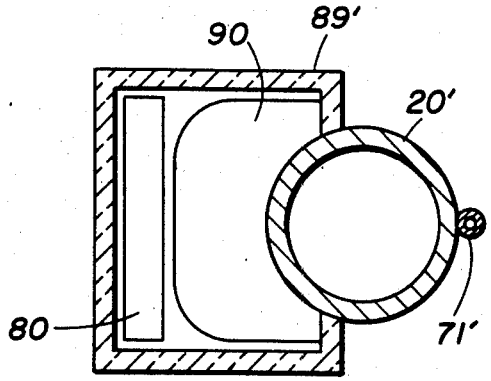
FIGS. 6 and 7 are cross-sectional views taken substantially along lines 6—6, and 7—7 of FIG. 4.
Figure 7:
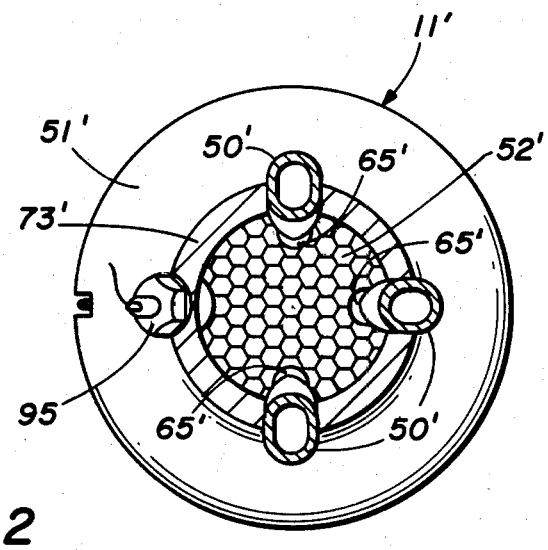

As shown more particularly in FIG. 2, the catalyst 12 in the combustor 11 is generally cylindrical in shape and is supported within the combustor housing 51 by means of a series of concentric cylindrical members including a thermal insulating fibrous mat sleeve 53 surrounding the catalyst to support the catalyst against substantial movement in a radial direction while still allowing for thermal expansion and contraction. Outside of the sleeve is a monolith support tube 54 whose lower end 55 abuts a support ring 56 which is held longitudinally in the housing by means of radial support projections 57 integrally formed with and extending inwardly from the combustor housing. Inwardly extending support flanges 59 integrally formed with the inside surface of the support tube abut the lower end of the bottom cell 60 of the catalyst to support the latter upwardly in the housing 51. At the upper end of the support tube 54, a bellville snap ring 63 seats within a groove to allow the monolith to expand and contract while still providing vertical support.

In catalytically combusting the fuel, the temperature of the burn-mixture as it enters the catalyst 12 must be high enough for at least some of the fuel in the mixture to have vaporized so the oxidation reaction can take place. This is assuming that the temperature of the catalyst is close to its operating temperature so that the vaporized fuel will burn thereby causing the remaining fuel in the burn-mixture to vaporize and burn. Thus it is desirable to preheat either the fuel-mixture or the air or the catalyst to achieve the temperature levels at which it is desirable for catalytic combustion to take place.

In accordance with one advantageous feature of the present invention, preheating is achieved by utilizing some of the heat generated during combustion. For this purpose, a device is provided in the combustor between the inlet and discharge chambers 24 and 25 for conducting some of the heat from combustion of the fuel to at least one of the components of the burn-mixture so as to preheat the fluids entering the catalyst 12. Advantageously, this construction provides adequate preheating for vaporization of enough of the fuel to sustain normal catalytic combustion of the burn-mixture autothermally, that is to say, without need of heat from some external source. Moreover, this allows for use of heavier fuels in the burn-mixture as the viscosity of such fuels lowers and their vapor pressures increase with increasing temperature.

In the present instance, the device for delivering preheat to the burn-mixture prior to its entering the catalyst 12, includes four angularly spaced tubes 67 communicating between the combustor inlet and discharge chambers 24 and 25 (see FIG. 2). The tubes are located within the combustor housing 51 between the inside wall of the housing and the outside of the catalyst support tube 54. Opposite end portions 69 and 70 of each of the tubes 67 are bent to extend generally radially inward with the lower end portions 69 being also flared upwardly so that hot combustion products from the discharge chamber 25 may first flow downwardly and then radially outward through the tubes. Thereafter, the hot combustion products, including some steam flow upwardly through the tubes and at the upper end portions 70 thereof flow radially inward to mix with the fuel-mixture and air within the inlet chamber 24. The heat in this discharge fluid thus provides the heat necessary for raising the temperature of the fluids in the inlet chamber preferably to the catalytic instantaneous ignition temperature of the resuling burn-mixture. The number of, the internal diameter of, and the inlet design of, the flow tubes at least to some extent determines the rate at which heat may be transferred from the discharge chamber back to the inlet chamber.

This unique preheat construction relies upon what is believed to be the natural increase in pressure of the products of combustion (steam and hot gases) over the pressure of the fluid stream passing through the catalyst 12 in order to drive heat back to the inlet chamber 24. This may be explained more fully by considering the temperature profile (see FIG. 12) of the combustor 11. Because the temperature profile for a constant volume of gas can be translated directly into a dynamic pressure profile, it may be seen that the temperature of the fluid stream passing through the catalyst rises as combustion occurs. As shown in the profile, the temperature, $T_{fs}$, of the fluid stream rises slightly and then decreases as the emulsion passes through the spray nozzles 65 which are located at the point A in the temperature profile. Feedback heat F enters at the point B on the profile to keep the temperature from falling further due to the sudden drop in pressure as the fuel-mixture is sprayed from the nozzles. The point C on the profile indicates the beginning of catalytic combustion which is completed just prior to the point D. Throughout the catalyst 12 the temperature of the fluid stream flowing therethrough first increases sharply and then levels off as combustion of the fuel in the fluid stream is completed. At point E, additional water is injected into the heated products of combustion and the super heated steam exiting the catalyst to bring down the temperature of this fluid mixture before performing work. Although the foregoing arrangement for directly preheating the burn-mixture prior to entering the catalyst is thought to be particularly useful in the exemplary combustor, other methods of preheating such as by indirect contact of the burn-mixture with the exhaust products (such as through a heat exchanger) or by electrical preheaters also may be acceptable methods of preheating. Additionally, it will be recognized herein that some of the radiant heat absorbed by the heat shield 52 will be absorbed by the burn-mixture as it passes through the shield to also help in preheating the burn-mixture.

For the post combustion injection of water into the heated fluid stream produced by the combustor 11, a water supply line 71 (see FIGS. 1 and 2) is connected through an end 73 of the housing 51 and extends into the discharge chamber 25. A nozzle end 74 of the line directs water into the flow path of the heated fluid stream exiting the catalyst 12. To deliver the injection water to the combustor, the pump 31 communicates with the storage tank 43 of the deionized water end circulates this cooler water through loops 74 and 75 connecting with heat exchangers 76 and 77 in the prime mover and compressor, respectively, to absorb heat that therwise would be lost from the system by operation of these two devices. This water then is delivered through line 71 to the combustor 11 for post injection cooling of the super heated steam exiting the catalyst.

THE FUEL

In accordance with another important feature of the present invention, the relative mass flow of diluent or water to fuel is regulated to obtain a burn-mixture which is an admixture whose theoretical adiabatic flame temperature for catalytic combustion is above the lower stability limit temperature of the catalyst 12 and below the upper stability limit temperature of the catalyst and its support. Specifically, in testing burn-mixtures under autothermal conditions where a portion of the diluent in the burn-mixture is derived from liquid water, such as the water in the emulsion, it has been discovered the weight percent of recycled combustion products relative to the weight percent of the total diluent in the burn-mixture is limited to the range of 40–94% in order to provide a burn-mixture combustible catalytically within the stability limits of the catalyst. The limiting factor defining the 94% upper end of this range appears to be attributable to mechanical constraints in the recycle device while the lower 40% limit is believed to be due to the lower temperature stability limit of the catalyst. In a preferred example, an emulsion of heavy crude oil, air and recycled combustion products were combined at 500 psia to form a burn-mixture which had a diluent to fuel ratio of 11.16:1 and which achieved a steady-state peak catalytic combustion temperature of approximately 2300° F. Specifically, the combustion occurred at an equivalence ratio of 1.02 which is a number representing the actual fuel/air ratio in the burn-mixture being combusted divided by the theoretical stoichiometric fuel/air ratio of the burn-mixture. The fuel emulsified in this example had a mass ratio of 2.85:1 water to 13° API heavy crude oil, the latter having a carbon to hydrogen weight ratio of 7.75:1 and a lower heating value of 16,955 Btu/lb. With the air temperature being 93° F. and a 60% by weight recycle of the hot combustion products relative to the air, the burn-mixture was at a calculated temperature of 537° F. upon introduction to the catalyst, assuming thermodynamic equilibrium between the components of the burn-mixture. For definitional purposes herein, the diluent comprises the non-combustible components of the burn-mixture excluding those contributed by the air but including those in the hot recycled combustion products. Specifically, the diluent in the present example includes a major portion comprised of $H_2O$, both from the emulsion and the combustion products, as well as $N_2$, $CO_2$, $SO_2$ from the combustion products and a minor portion which is comprised of the atmospheric inerts found in the combustion products.

In more particularly defining one end of a range of novel burn-mixtures usable in the exemplary combustor with the above identified 13° API heavy crude oil, a calculated mass ratio of 5.7:1 diluent to fuel in the burn-mixture should produce a theoretical upper adiabatic flame temperature of about 3004° F. in the combustor when: a fuel-mixture emulsion having a mass ratio of 1.5:1 water to oil is used, air enters at 93° F, a 30% combustion gas recycle by weight relative to the air is used, combustion occurs at an equivalence ratio of 1.0, and the burn-mixture is introduced to the catalyst at 500 psia and a calculated temperature of 489° F. The foregoing is based upon the considerations that (1) catalysts (i.e. platinum with rhodium on alumina layered on an yittria stabilized zirconia support) presently appear to be able to withstand theoretical adiabatic flame temperatures not much greater than about 3000° F., thus the critical limit for the mass ratio of the fuel-mixture is 1.5:1, and (2) catalysts (i.e. one having a high pore volume alumina wash coat impregnated with a high concentration of precious metals such as palladium with platinum on a cordierite support) presently appear to be able to burn heavy crude oil only at temperatures greater than about 490° F., so that the lower critical limit in amount of recycle combustion products is 30%, by weight, of the incoming air.

At the other end of the novel range of burn-mixtures using the heavy crude oil, a calculated mass ratio of 26.2:1 diluent to fuel in the burn-mixture should produce a theoretical adiabatic flame temperature of 1796° F. in the combustor when: a fuel-mixture having a water to oil mass ratio of 5.0:1 is used, air enters at 93° F., a 150% combustion gas recycle is used and the resulting burn-mixture is introduced to the catalyst at 500 psia at a calculated temperature of 640° F. and combustion occurs at an equivalence ratio of 1.0. Factors important in defining this latter upper limit of the burn-mixture range are that a homogeneous combustion reaction is not believed significant at combustion temperatures below about 1800° F., (at least for combustor operation at lower air pressures in the general range of 44 to 55 psia), and that a 150% recycle mass ratio of combustion products relative to air appears to be the upper limit which is achievable mechanically. Both of these, however, are determinative of the critical overall limitation, which remains to be the lower stability limit temperature of the catalyst used in the combustion process.

To make the fuel-mixture emulsion utilizing crude oil, the naturally occurring acids in the crude oil are saponified using a basic moiety, such as ammonia ($NH_3$) or ammonium hydroxide ($NH_4OH$). The soaps thus formed stabilize the emulsion as an oil in water emulsion when formed by high shear mixing together of the water and oil phases. Preferably, enough ammonia is used so that the final emulsion has a slight excess of ammonia, but it is desirable that the salt content of the water be kept sufficiently low initially to avoid "salting out" or breakage of the emulsion. Two key parameters which are used in the preparation of crude oil and water emulsions are the hydrogen ion concentration, pH, and electrical specific conductance, typically in units of micro mhos, of the water and ammonium hydroxide.

In one example of a crude oil and water emulsion, deionized water was prepared by ion exchange purification of tap water in cation, anion, and mixed resin beds with the water having an initial specific conductance of 38 micro mhos and an initial pH of 4.1. This water was mixed with a sufficient quantity of a solution of ammonium hydroxide (having a concentration of 29.8% by weight as $NH_3$ in water, an initial specific conductance of 68 micro mhos, and an initial pH of 13.51) to form ammoniated water with a pH of 11. This ammoniated water and 13.6° API Shell Tulare heavy crude oil (having a carbon to hydrogen weight ratio of 7.53:1, and an acid number of 5.06 mg KOH/g oil) were heated to between 100° to 140° F. and mixed together in a weight ratio of 2.86:1 ($H_2O$/oil) with a high shear pump to form an emulsified fuel-mixture having a temperature of 113° F., a specific conductance of 340 micro mhos and pH of 10.1. In observation, this emulsion appeared to consist of finely divided oil droplets in water, was brown in color and had slight surface foam.

Preferably, in making an emulsion with the crude oil, the ammoniated water pH should be kept generally within the range of 10–11.7. This will help to avoid poor emulsion stability when the pH is less than 10 and to avoid excessive emulsion foam when the pH is greater than 11.7. Moreover, in order for the emulsion to remain fairly stable, the particle size of the dispersed phase, the oil phase, should be less than 10–40 microns.

Further, with regard to the components of the burn-mixture, it will be appreciated that different fuels and diluent combinations may be utilized. Hydrogen gas or distillate fuels can be used instead of heavy crude oil and diluents including nitrogen gas, carbon dioxide gas, and/or sulfur dioxide plus the recycled combustion products (including $CO_2$, $H_2$, $H_2O$, $SO_2$, $NO_x$, unburned hydrocarbon, CO, for example) may be suitable for use as long as they have a high heat capacity and are compatible both with the catalytic combustion system and the intended use for the heated working fluid. Such uses may include for example enhanced oil recovery processes utilizing heated water, steam, nitrogen or carbon dioxide; or acid manufacturing processes using heated $SO_2$.

If hydrogen gas were used as the fuel component, a lower limit of a calculated mass ratio of diluent to the hydrogen fuel in the burn-mixture is 33.7:1, resulting in a theoretical adiabatic flame temperature of 3006° F. when: combustion occurs at an equivalence ratio of 1.0, the hydrogen has a lower heating value of 51,590 Btu/lb, the fuel-mixture is liquid water sprayed into the combustion with the hydrogen gas in a ratio of 6.3:1, the air temperature is 93° F., the combustion products recycle is 80%, and the burn-mixture has a calculated temperature of 354° F., again assuming thermodynamic equilibrium. An upper limit of a calculated mass ratio of diluent to hydrogen is 67.4:1 which results in a theoretical adiabatic flame temperature of about 1800° F. with: combustion occurring at an equivalence ratio of 1.0, the fuel-mixture mass ratio being 16.0:1 ($H_2O$:H), the recycle being 150%, the burn-mixture being at 500 psia and a calculated 380° F. and with the other conditions the same. A preferred set of conditions for utilizing hydrogen as the fuel contemplates a diluent to fuel weight ratio of 45.0:1, with a water to fuel spray ratio of 7.0:1 so that the theoretical and adiabatic flame temperature is 2881° F. when: the burn-mixture temperature is a calculated 363° F. and the recycle is 110%, with the other conditions being the same.

If a distillate fuel oil such as diesel #2 were used wherein the oil is 32° API and has a carbon to hydrogen weight ratio of 6.73 with a lower heating value of 17,829 Btu/lb, the lower limit of a calculated mass ratio of diluent to fuel for the burn-mixture would be 5.28:1, resulting in a theoretical adiabatic flame temperature of 3005° F. when combustion occurs at an equivalence ratio of 1.0, the fuel mixture is an oil-in-water emulsion with a mass ratio of 1.65:1, the air temperature is 93° F., the recycle is 25%, and the burn-mixture is at 500 psia and a calculated temperature of 363° F. For this fuel, the upper limit of the mass ratio of diluent to fuel for the burn-mixture would be 27.3:1, producing a theoretical adiabatic flame temperature of 1756° F. when: the fuel-mixture emulsion mass ratio is 5.5:1, the recycle is 150%, the calculated burn-mixture temperature is 591° F., and the other conditions are the same.

For emulsions including diesel fuel an artificial surfactant is added to encourgage emulsification because diesel fuel does not have a high natural acid number. Accordingly, a surfactant such as one of an ethylene oxide type may be used to form the emulsion. Preferably, the surfactant is chosen so that its HLB value favors a stable emulsion of diesel oil in water. An example of such a surfactant manufactured by Shell Oil Company is "NEODOL 91-8", containing 9 to 10 carbon atoms per molecule and 8 moles of ethylene oxide per mole of hydrogen. Using this surfactant in a 0.50%, by weight concentration with the deionized water mentioned above and diesel oil 32° API, a 3.1:1 water to oil ratio emulsion was made. This emulsion was used in forming a preferred burn-mixture having a diluent to fuel weight ratio of 12.03 and the burn-mixture was combusted at an equivalence ratio of 1.00 with an air temperature of 93° F. (authothermal conditions) and 62% recycle. These conditions resulted experimentally in a peak combustion temperature of approximately 2200° F. with a burn-mixture at 370 psia and a computed temperature of 544° F. assuming thermodynamic equilibrium.

In another experiment in which recycled combustion products were not used, nitrogen was mixed with the air as a co-diluent with the water in the fuel emulsion. The experimental conditions were: diluent to fuel weight ratio of 21.29:1 where 32° API #2 fuel oil had a C/H wt. ratio of 6.73 was burnt with a lower heating value of 17,829 Btu/lb at a water-fo-fuel emulsion weight ratio of 1.53:1, at an equivalence ratio of about 0.9 with air and nitrogen introduced at 860° F. and a nitrogen to air weight ratio of 1.22:1. This resulted in an actual combustion temperature of 2030° F. and a $NO_x$ concentration less than 3 PPMV on a dry basis. A second experiment was conducted with nitrogen mixed with the air as a co-diluent with the water in the fuel emulsion. In this case, the experimental conditions were: diluent to fuel weight ratio of 20.12:1 for #2 fuel oil of the properties given above which was burnt at a water-to-fuel emulsion weight ratio of 1.53:1, at an equivalence ratio of about 0.93 with air and nitrogen introduced at 734° F. and a nitrogen to air weight ratio of 1.19:1. This resulted in an actual combustion temperature of 2030° F. and a $NO_x$ concentration of less than 11.0 PPMV on a dry basis. Both of these tests indicate the efficacy of nitrogen gas in conjunction with liquid water as diluent components.

In a similar experiment, nitrogen alone was used as a diluent. The experimental conditions were: diluent to #2 fuel oil weight ratio of 21.91:1 for #2 fuel oil of the properties given above which was burnt at a water-to-fuel ratio of 0, no water being used, at an equivalence ratio of about 10.87 with air and nitrogen introduced at 707° F. This resulted in an actual combustion temperature of 2030° F. This test indicated the usefulness of nitrogen gas alone as the diluent.

In an additional similar experiment to determine the effectiveness of steam and small amounts of nitrogen air as diluent components in conjunction with water in the fuel emulsion was established. In this test, the experimental conditions were: diluent #2 fuel oil weight ratio of 9.93:1 including a nitrogen to fuel weight ratio of 3.61:1 at a water-to-fuel weight ratio of 1.53 and an equivalence ratio of about 1.13 with air and superheated steam introduced at 770° F. The fuel emulsion and nitrogen were introduced at ambient temperature. This resulted in an actual combustion temperature of 2012° F. A related experiment was conducted to determine the effectiveness of steam and small amounts of nitrogen as diluent components in conjunction with water in the fuel emulsion. The experimental conditions were: a diluent to fuel weight ratio of 25.76:1 including a nitrogen gas to fuel weight ratio of 4.12:1 at a $H_2O$:F emulsion weight ratio of 1.53:1 and an equivalence ratio of about 0.81 with air and super heated steam introduced at 914° F. The fuel emulsion and nitrogen were introduced at ambient temperature. This resulted in an actual combustion temperature of 1868° F. and a $NO_x$ of less than 2 PPMV dry basis. These latter two experiments indicate the usefulness of nitrogen gas, steam and liquid water as diluent components and the fact that diluent to fuel ratios of 25.76:1 are useful.

THE CONTROLS

With regard to the control of fluid flow for regulation of the burn-mixture, the exemplary system includes sensor means including the temperature sensor TS2 for determining the temperature $T_2$ of the heated fluid stream exiting the catalyst 12 and control means responsive to such sensor. The control means regulate the proportions of diluent and fuel in the burn-mixture so that, if combusted with theoretical quantities of oxidant, the temperature of the resulting fluid stream theoretically is the aforesaid specified temperature. Advantageously, with this arrangement the thermal efficiency of the combustor is maximized and losses in mechanical efficiency resulting from otherwise excessive pumping are minimized.

In the present instance, a schematic illustration of the exemplary system controls is shown in FIG. 8 and includes the thermocouples TS1, TS2 and TS3 for detecting the temperature $T_1$ within the catalyst inlet chamber 24, the temperature $T_2$ at the outlet end of the catalyst 12 prior to post combustion water injection and the temperature $T_3$ of the steam discharged from the combustor 11. Additionally, the oxygen sensor OS disposed within the discharge chamber 25 serves to detect the presence of oxygen in the heated fluid stream to provide a control signal to aid the computer 27 in controlling combustion relative to stoichiometric. More specifically, signals representing the temperatures $T_1$, $T_2$, $T_3$ and oxygen content are processed through suitable amplifiers 79 and a controller 80 before entering the computer. The temperature signals are processed relative to a reference temperature provided by a thermistor 81 to obtain absolute temperatures. Thereafter, both the temperature and oxygen content signals are fed to an analog to digital converter 83 for delivery to the computer 27 to be at least temporarily stored within the computer as data. This information along with other information stored in the computer is then processed to provide output signals which are fed through a digital to analog converter 84 to provide appropriate control signals for controlling flow regulating devices 85, 86, 87, 88 for the air compressor 21, the emulsion water pump 29 and the fuel pump 30, and the injection water pump 31, respectively. As the temperatures $T_1$, $T_2$ and $T_3$ and oxygen content of the heated fluid stream may vary during the course of operation of the combustor 11, the data fed into the computer 27 changes resulting in the changes being made in the output signals of the computer and in turn the control signals controlling the proportions of flow in the components of the fuel and the air forming the burn-mixture.

As shown in FIGS. 2 and 4, the thermocouples TS1, TS2 and TS3 and the oxygen sensor OS are connected by leads through the housing 51 of the combustor 11 and to box 89 containing the controller 80. In the well head system shown in FIGS. 1 and 2, the box 89 is mounted adjacent the combustor housing 51. In the downhole system shown in FIGS. 34*a* and 46, the insulated box 89' is hermetically sealed to the tubing string 35' which connects with the top 73' of the combustor housing 51. Heat conducting fins 90 mounted within the box 89' are connected with the tubing 35' so that the air flowing through the tubing may be utilized to maintain a standard temperature within the box for proper operation of the thermistor 81'.

Part of the information providing a data base for the computer 27, is illustrated graphically in FIG. 13 which shows general combustor temperature curves at varying air-fuel ratios for three different fuel admixtures. For example, curve I represents the temperature of the fluid stream produced by combustion of an emulsion having a water to fuel ratio of 5.2 with different air-fuel ratios and curve II represents the temperature of heated fluid stream produced by combination of an emulsion having a mass ratio of water to fuel of 6.2. The water to fuel ratio associated with curve III is even higher. The peak temperature for each curve occurs theoretically when the air to fuel-admixture ratio is stoichiometric. The vertical line "S" in the graph represents generally the stoichiometric ratio of air to fuel-admixture. As may be seen from the curves, when there is excessive fuel for the amount of air (a rich mixture) the temperature of combustion is lower than the peak temperature for the particular mass ratio being combusted. Similarly, if there is excessive air, the temperature also drops. Moreover, it is seen that as the water content of the fuel-admixture increases, the peak temperature decreases, the water serving to absorb some of the heat of combustion. While the curves illustrated in FIG. 13 show different fuel-admixtures, the heating valve of the fuel portion of each of the admixtures is the same. For fuels having different heating valves, the temperatures of combustion for equal mass ratios of admixture utilizing such different fuels will vary from one fuel to next. Accordingly, the data base of the computer is provided with comparable information for each fuel to be used.

Figure 9:
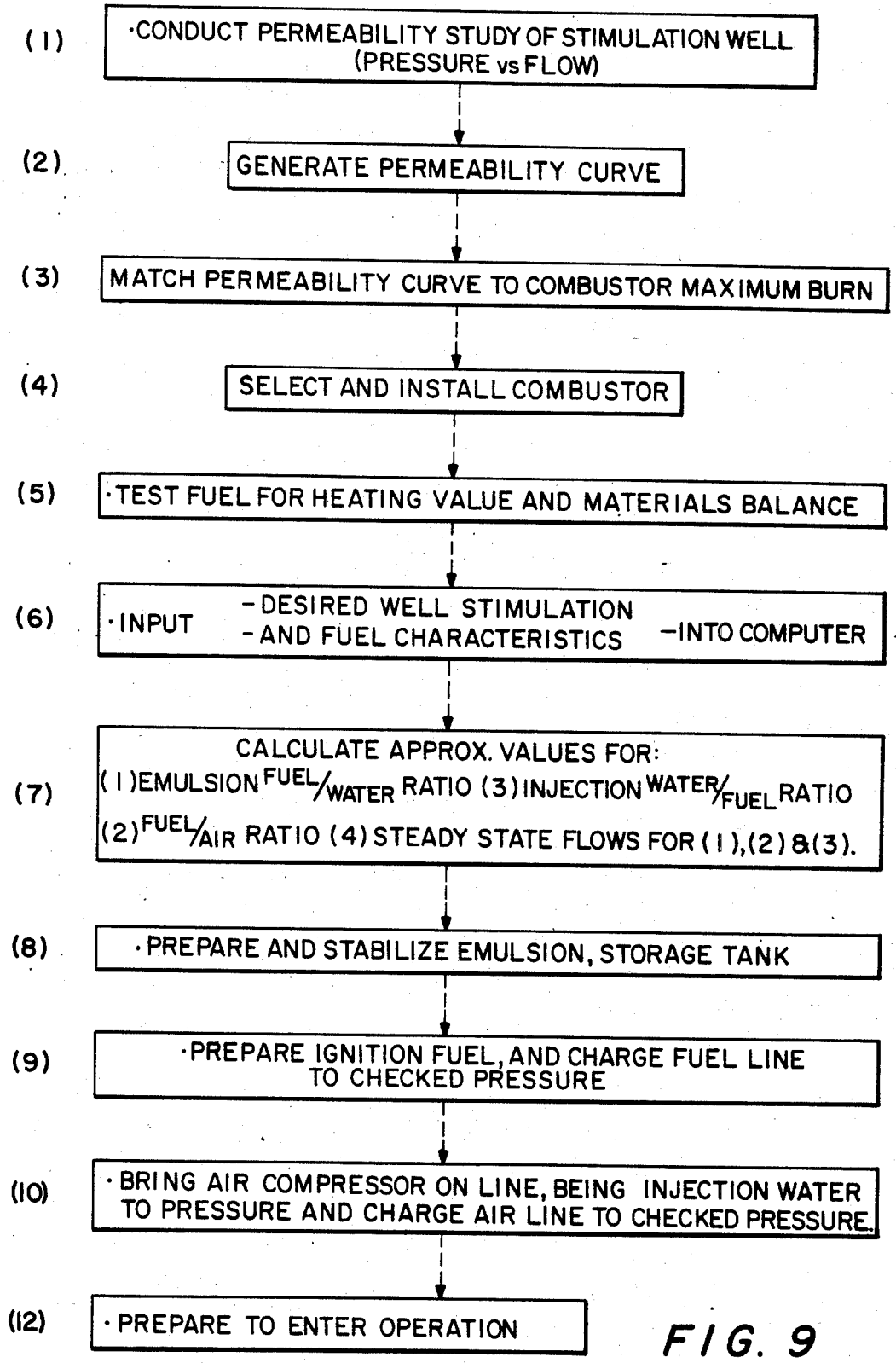
FIGS. 9, 10, 11*a* and 11*b* are flow diagrams of steps performed in the operation of the exemplary steam generating systems.

In addition to the foregoing information, the data base of the computer 27 is provided with specific information including that resulting from preliminary processing steps performed to obtain information unique to each end use contemplated for the combustor's heated output fluid. An example of such is shown in outline form in FIG. 9 such as when preparing the combustor for use in steam flooding an oil bearing formation.

Generally speaking, the physical characteristics of each oil bearing formation are unique and such characteristics as permeability, porosity, strength, pressure and temperature affect the ability of the formation to accept steam and release oil. Accordingly, oil from different oil bearing formations may be produced most efficiently by injection of steam at different flow rates, pressures and temperatures dependent upon the formation's ability to accept flow and withstand heat and pressure without being damaged.

In accordance with one of the more important aspects of the present invention, the exemplary combustor 11 may be used to produce oil from oil bearing formations which have substantially different physical characteristics by providing a heated working fluid over a wide range of heat release rates, pressures and temperatures so as to best match the needs of a formation for efficient production of oil from that formation. Briefly, this is derived by first testing the formation to be produced to determine the desired production parameters such as pressure, heat release rate and temperature and then matching the combustor output to these parameters by operating the combustor in a particularly novel manner to provide a heated working fluid output matching these conditions. Initially, this is done by selection of the combustor catalyst size which provides the widest combustor operating envelope within desired production parameters for the formation. Then, during combustor operation, the flow of air, fuel and diluent advantageously may be adjusted to precisely achieve the output characteristics desired even if these characteristics may change because of changes in the formation characteristics due to the induced flow of fluids through the formation. Thus, for example, the heat release rate of the combustor may be adjusted by changing the rate of flow of the carbonaceous fuel through the catalyst without affecting the temperature of the working fluid by making corresponding changes in the diluent and air flowing through the combustor. Advantageously, this may be effected over a substantially wide range of heat release rates by selectively proportioning the total water flowing through the combustor between that water which is added to the fuel to make the fuel-mixture and that which is injected subsequent to combustion so as to maintain a flow of the burn-mixture over the catalyst within a range of linear velocities at which efficient combustion of the fuel takes place.

When using the exemplary system in a steam flooding operation, the amount of air to be pumped into the combustor 11 for oxidizing the fuel may be established theoretically by conducting a permeability study of the well which is to receive the steam. Preferably, this is done utilizing nitrogen gas which may be provided from a high pressure source (not shown) to generate empirically a reservoir injectivity curve unique to the formation to be flooded. The use of nitrogen gas is preferred over air so as to avoid forcing oxygen into the formation and risking the possibility of fire in the formation. Available calculational techniques employed by petroleum engineers enable conversion of the flow and pressure data obtained using nitrogen into similar data for the heated fluid stream produced by the combustor. With this latter data, a theoretical injectivity curve (see FIG. 14) for the formation may be generated for selecting the dimensions of the catalyst 12 used in the combustor 11 in order to obtain a maximum heat release rate and steam flow for the combustor.

Figure 15:
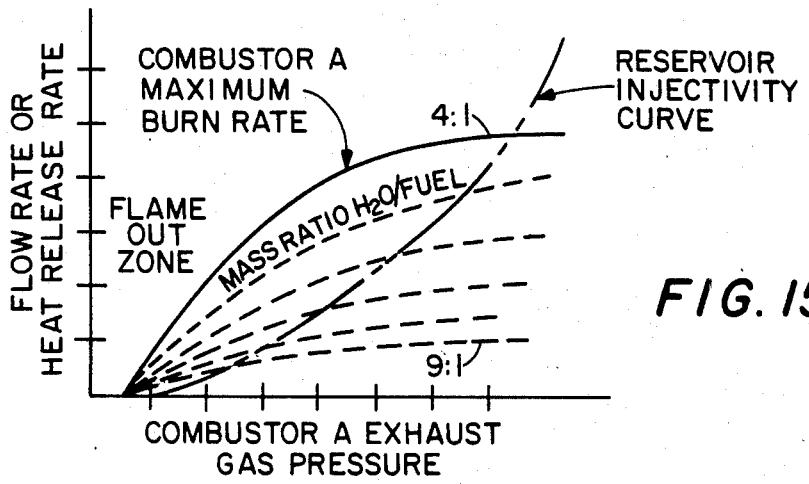
FIGS. 15 and 16 are maximum burn rate curves for different fuel-mixtures for a combustor equipped with catalysts of two different sizes; with the curve of FIG. 15 matched with the injectivity curve of FIG. 14.
Figure 16:
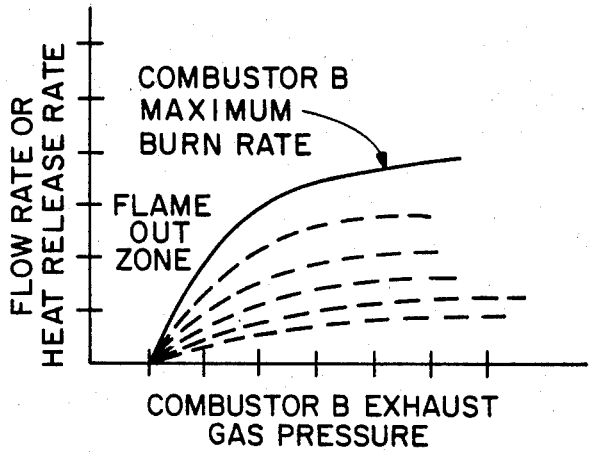
Figure 17:
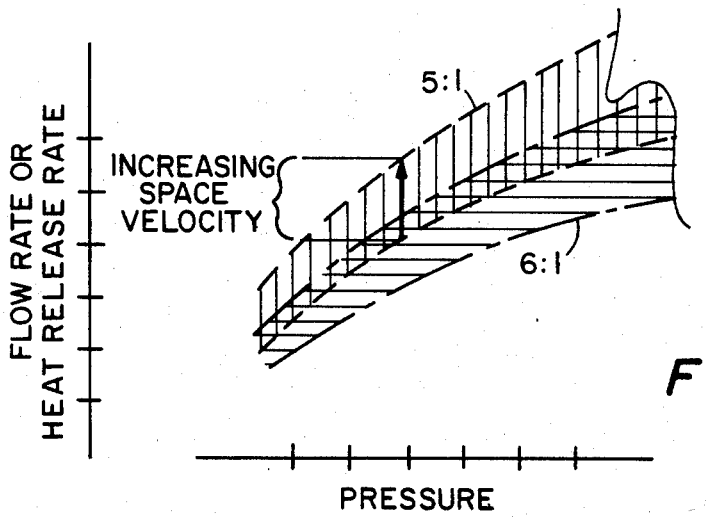
FIG. 17 is an enlarged section of the curve shown in FIG. 15 illustrating the overlapping operative ranges of the combustor for fuel-mixtures having a different water:fuel mass ratios.

As shown in FIGS. 15 and 16, different sizes of catalyst 12 perform most efficiently at different heat release rates and pressures. FIG. 15 illustrates a representative maximum burn rate curve for combustor A having one size of catalyst while FIG. 16 illustrates a second representative maximum burn rate curve for combustor B having another size of catalyst. The physical dimensions, largely diameter and length, of the catalysts determine the slopes of these maximum burn rate curves for each stoichiometric burn-mixture while the rates of combustion are functions of the mass flow of the burn-mixture and the pressure at which the burn-mixture is passed over the catalyst. The area above the curves in these two figures represents a flame out zone within which the rate of flame propagation for the burn-mixture being combusted is less than the linear velocity of the burn-mixture through the catalyst. The family of curves represented by the dashed lines in each graph illustrates fuel mixtures having different mass ratios of water to carbonaceous fuel with the curve of FIG. 15 illustrating representative mass ratios ranging from 9:1 to 4:1. In actuality, the dash lines of the maximum burn rate curves represent the center of the combustion envelope within which the particular fuel-mixture may be combusted at a given pressure over a range of heat release rates and linear velocities. A representative section of a maximum burn rate curve is shown in FIG. 17 for fuel-mixtures having mass ratios of 5:1 and 6:1 with the shaded cross-hatching representing the areas at which combustion of the mixtures may occur. As may be seen from this enlargement, the areas of combustion for these different mass ratios of water to fuel overlap each other.

To select the proper combustor for efficient thermal combustion under the operating conditions expected, the combustor chosen is the one whose combustor maximum burn curve most closely matches the injectivity curve of the formation. Matching is done to provide the combustor with the widest range of operating envelope for the desired flow and pressure at which the steam is to be injected into the formation. Advantageously then, as formation conditions change during operation the combustor can be adjusted to compensate for the changes and still provide the output desired.

Once the proper size of catalyst 12 has been chosen and the catalyst is installed in the combustor housing 51, then the combustor 11 may be connected with the well for delivery of steam to the formation for steam flooding purposes. But, before steam flooding, a test is made of the fuel to be combusted to determine its actual heating valve, and calculations performed to determine if the heat and materials balance for the burn-mixture selected using this fuel check theoretically across the combustor within the range of operating temperatures ($T_{2min}$, $T_{2max}$) for the combustor utilizing the selected size of catalyst. Assuming the fuel test is satisfactory, the information as to desired heat release rate, maximum combustor outlet temperature $T_3$ of the steam, maximum combustion temperature, $T_{2max}$, and steam pressure is fed as input data into the computer 27 for use in controlling operation of the combustor during start-up, shut down and steady state operations. Also, calculations are performed to obtain estimated values for the mass ratio of the fuel-mixture, the fuel/air ratio, the ratio of injection water to fuel, and the steady-state flow rates for the fuel-mixture air and injection water. From these figures, the flow regulating devices 85, 87, 86 and 88 associated with pumps 29, 30 and 31, respectively, may be set to provide the desired flow rates of fuel, water and air to the combustor. The flow rates for all of these fluids are first determined as estimated functions of the empirically established flow of nitrogen gas into the formation. Given the temperature data for the burn-mixture being combusted in accordance with the curves as illustrated in FIG. 13, these flow values may be established so as to have a theoretical stoichiometric combustion temperature within the aforesaid temperature range represented by the stability limits of the catalyst 12.

With the emulsion prepared at the proper mass ratio of water to carbonaceous fuel and the fuel, air and water supply lines 19, 20 and 71 leading to the combustor 11 charged to checked pressure, the combustor is ready to begin operation. The flow chart representing operation of the combustor is shown generally in FIG. 10 with a closed looped control for steady state combustion (step 20 FIG. 10) being shown in FIGS. 11*a* and 11*b*. The closed loop control for start-up of combustion (step 15 FIG. 10) is substantially the same as that for steady state operation except that the data base information to the computer 27 is characterized particularly as to the start fuel utilized. Accordingly, the specific description of the start-up control loop is omitted with the understanding that such would be substantially the same as the subsequently described steady state operation.

Upon entering operation (step 12), preignition flow rates are established in the fuel, air and water supply lines 19, 20 and 71, respectively opening the check valves 66 and 64 to cause ignition fuel and air to be delivered to the combustor 11 (step 13). In the surface version of the exemplary system, ignition (step 14) of the fuel is accomplished through the use of an electrical resistance igniter 58 located above the upper end of the catalyst 12 (see FIG. 2) while in the downhole version, the use of a glow plug 95 also is contemplated as an electrical starting means. Once the ignition fuel begins to burn, closed loop control (steps 15–17) of the ignition cycle continues until the combustion becomes stable. If the ignition burn is unstable after allowing for sufficient time to achieve stability, a restart attempt is made automatically (see FIG. 10 steps 12–16). Once stability is achieved in the ignition cycle, the steady state fuel for the fuel-mixture is phased in (step 18) with the system being brought gradually up to a steady state burning mode. As steady state burning continues, control of the combustor is maintained as is set forth in the closed loop control system illustrated in FIGS. 11*a* and 11*b*. In the closed loop control, the thermal couples TS1, TS2 and TS3 detect the temperatures within the inlet chamber 24, the discharge chamber 25, and the combustor outlet 26 and this information is fed to and stored in the computer 27 (see FIG. 11*a* sub-step A). Additionally, information as to the flow rates of the fuel-mixture, air and injection water are stored in the computer and heat and materials balances for the combustor system are calculated (sub-step B) using actual temperature data. Two heat and materials balances are computed, one for the overall system utilizing the actual output temperature $T_{3a}$ and one internal balance utilizing the catalyst discharge temperature or combustion temperature $T_2$. This information is utilized to assure proper functioning (sub-step C) of the various sensors in the system. If the sensors are determined to be functioning properly, then the system variables (water flow, fuel flow and air flow) are checked to make sure that they are within limits (sub-step F) to assure proper functioning of the combustor without damage being caused by inadvertently exceeding the stability limits of the catalyst 12 and the maximum temperature and heat release rates at which steam may be injected into the formation. If the variables are outside of the safety limits for the system, then the system is shut down. If the variables are within their limits, the computer analyzes the inputed temperature and fluid flow data to calculate the actual heat release rate of the combustor and compare it to the desired level to be fed into the formation being treated (sub-step G). If the actual heat release rate requires changing to obtain the heat release rate desired, the flow rates of the fuel-mixture, air and injection water are adjusted proportionally higher or lower as may be necessary to arrive at the desired heat release rate. Once the heat release rate is as desired, a comparison of the actual temperature ($T_{3a}$) of the heated working fluid discharged by the combustor to the set point temperature ($T_{3sp}$) for such fluid is made. Depending upon the results of comparison, the amount of injection water sprayed into the heated fluid is either increased or decreased to cause the actual temperature ($T_{3a}$) thereof to either decrease or increase so as to equal the discharge set point temperature. After reaching the desired set point temperature, the actual combustion temperature is checked by the computer to determine if the temperature $T_{2a}$ is within the stability limits of the catalyst. If so, the computer then checks the combustor to determine if the combustor is operating substantially at stoichiometry. If the temperature $T_{2a}$ requires correction, then an adjustment is made in the mass ratio of the water to fuel in the fuel-mixture. As the response time for making this type of correction may be fairly long, information as to prior similar corrections is stored in the computer data bank and is taken into consideration in making subsequent changes in the fuel-mixture mass ratios so as to avoid over compensation in making changes in the mixing of water and fuel to produce the emulsified fuel-mixture. Assuming that some form of correction is needed, the percentage of water in the fuel-mixture is either increased or decreased as may be appropriate to either decrease or increase the actual combustion temperature $T_{2a}$ to bring this temperature within the stability limits of the combustion system.

Advantageously, in making a change in the amount of fuel in the fuel-mixture, an equal but opposite change is made in the amount of injection water so that the total quantity of water passing through the combustor 11 remains the same (sub-steps K-N). As a result, the outlet fluid temperature $T_{3a}$ remains the same while allowing for adjustment in the combustion temperature to arrive at a temperature and linear velocity of fluids passing over the catalyst 12 at which combustion occurs most efficiently for the amount of fuel being combusted.

For example, if the actual combustion temperature $T_{2a}$ is found to be too low, and any previously corrected fuel-mixture has had time to reach the combustor, then by decreasing the amount of water in the fuel-mixture and making a corresponding increase in the amount of water in the injection water, the temperature $T_{2a}$ should increase without any corresponding change in the temperature $T_{3a}$ of the fluids exhausted from the combustor. If the combustion temperature $T_{2a}$ were too high, the reverse follows with the combustion temperature $T_{2a}$ being lowered by increasing the quantity of water in the fuel-mixture and decreasing the amount of injection water by a like quantity.

Figure 11A:
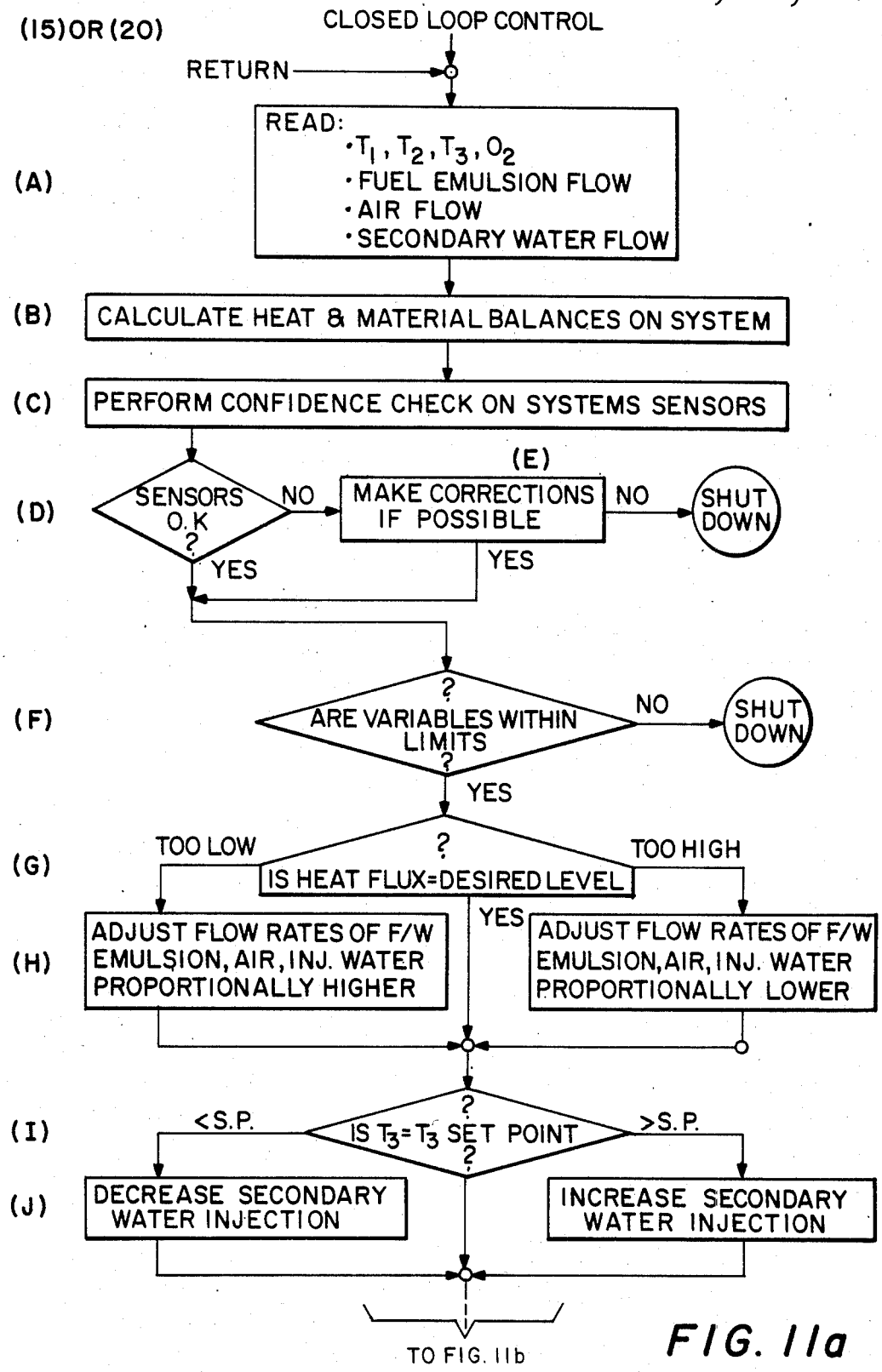
Figure 11B:
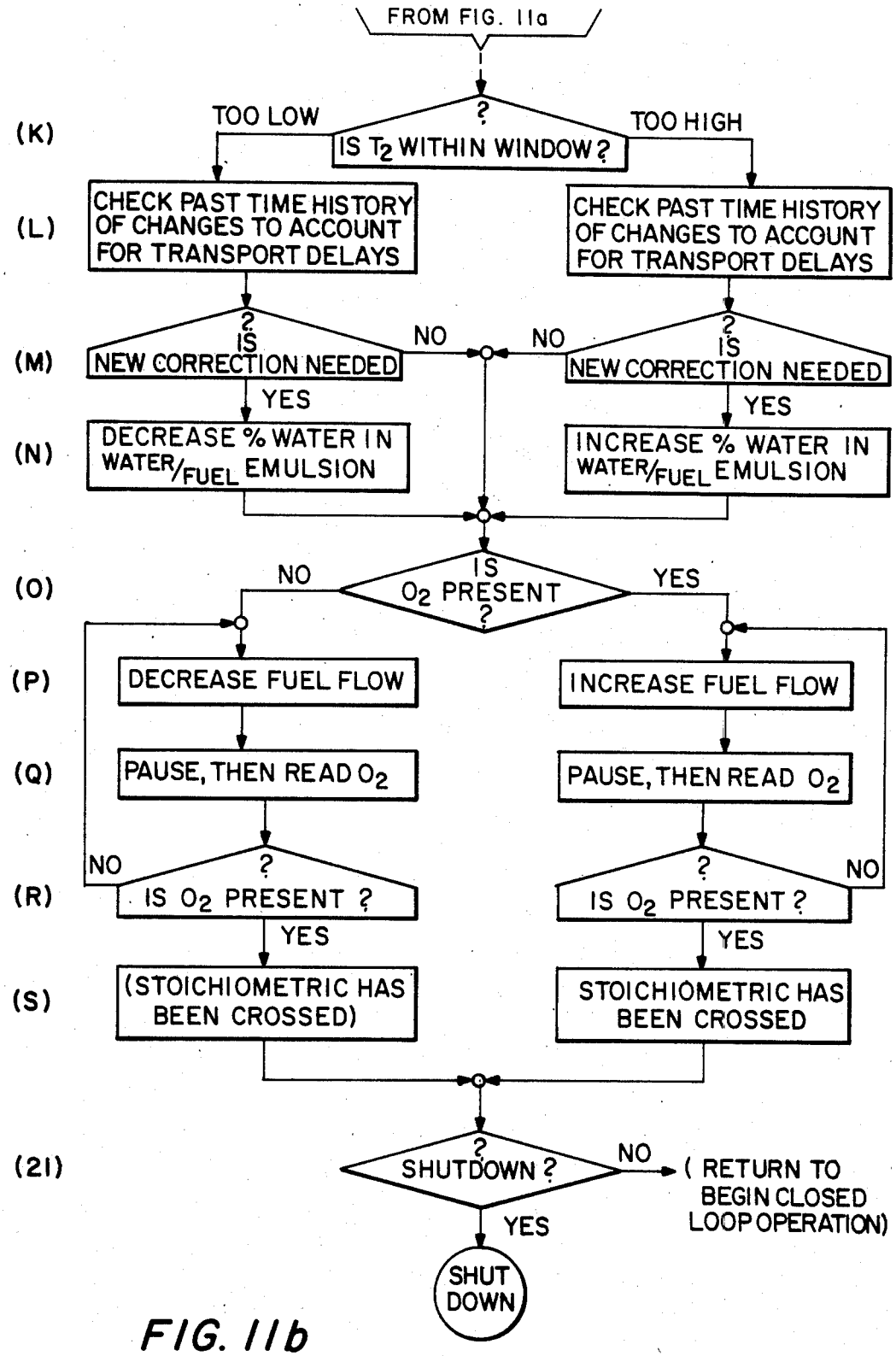

To assure combustion in stoichiometric quantities, the oxygen sensor OS is utilized to detect the oxygen content (presence or absence) of oxygen in the heated fluids in the discharge chamber 25 of the combustor 11. If oxygen is present in these heated fluids, the fuel-mixture is being combusted lean and conversely, if no oxygen is present, the fuel-mixture is being combusted either stoichiometrically or as a rich mixture. To obtain stoichiometric combustion herein, the amount of fuel is increased or decreased relative to the amount of oxygen being supplied to the combustor until the change in the amount of fuel is negligible in changing from an indication of oxygen presence to an indication that oxygen is not present in the heated discharge fluid of the combustor. Thus, for example in FIG. 11*b*, substeps O-S of step 20, if oxygen is determined to be present, the fuel flow is increased relative to the oxygen flow to provide additional fuel in a small incremental amount for combusting with the amount of air being supplied to the combustor. After a suitable period of time has passed allowing the combustor to respond to the change in the burn-mixture, data from the oxygen sensors is again considered by the computer to determine whether oxygen is present or absent. If oxygen is present, this sub-cycle repeats to again increase the fuel supplied to the combustor. However, if no oxygen is detected as being present, then stoichiometry has been crossed and the burn-mixture will be being supplied to the combustor in substantially stoichiometric quantities. If oxygen is found to be present in the first instance, the fuel supply is decreased incrementally relative to the oxygen supply in a similar manner until stoichiometry is crossed. While the foregoing description establishing stoichiometric combustion by controlling the relative amounts of fuel and oxygen, this may be accomplished either by adjusting the flow of fuel relative to a fixed amount of air as shown in FIG. 11*b* or by adjusting the flow of air relative to a fixed amount of fuel.

Once the combustor 11 is burning stoichiometrically, the control process recycles continuously computing through the closed loop control cycle (step 20) to maintain stoichiometric combustion at the desired heat release rate and output temperature $T_{3sp}$ until the steam flooding operation is completed. At the end of each cycle, if the operation has not received a shut-down signal (step 21) the loop repeats, otherwise, the system is shut down.

As an alternative method of establishing stoichiometric combustion of the fuel-mixture without the use of an oxygen sensor, the actual combustion temperature $T_{2a}$ for a particular fuel may be used as a secondary indication of stoichiometric combustion. In this connection, the information disclosed in FIG. 13 and previously described herein is utilized to vary the flow volume of the emulsion relative to the volume of air in order to obtain stoichiometric quantities of air and fuel for combustion in the combustor 11. In considering the graph of FIG. 13, it will be appreciated that in attempting to reach the peak temperature of a curve, it is necessary to know whether combustion is taking place with a burn-mixture which is either rich or lean. If the burn-mixture is rich, the proportional flow of emulsion should be decreased relative to the flow of air in order to increase the combustion temperature to a peak temperature. But if the combustion mixture is lean, it is necessary to increase the proportion of emulsion relative to air in order to increase the combustion temperature to a peak temperature. Accordingly, the first determination made is whether the temperature $T_{2a}$ for the existing emulsion has increased or decreased over the temperature previously read into the computer data base in response to a change in the emulsion flow rate. If the temperature $T_{2a}$ has increased, then the flow of emulsion should be increased again if the flow of emulsion was increased previously. This would occur when burning lean. If the temperature has increased in response to relative decrease in the flow volume of the emulsion to air, then the flow volume of emulsion should be decreased again and this would occur when burning rich. If, on the other hand, the temperature $T_{2a}$ has decreased and the flow of emulsion was also decreased previously, the flow of emulsion should be adjusted upwardly because this set of conditions would indicate lean burning. Alternatively, if the temperature has decreased and the flow of emulsion was increased previously, the flow of emulsion should be decreased because this set of conditions would indicate rich burning. Continued checking of the temperature and the making of corresponding subsequent adjustments in the relative flow of emulsion to air are made in finer and finer increments to obtain stoichiometric flow rates of the air and emulsion for a particular fuel.

Advantageously, with the combustor system as described thus far, it will be appreciated that as formation conditions change, the combustor operation can be adjusted automatically within limits to provide the desired heat release rate to the formation at the desired temperature $T_3$ while still combusting efficiently. For example, assuming that as the steam flooding proceeds over a period of time the injectivity of the formation increases, then the working fluid produced by the combustor will flow into the formation more easily and because of this, flow past the catalyst 12 will increase thereby tending to increase the heat release rate into the formation. With the exemplary combustor howwver, adjustment may be made in the heat release rate by reducing the relative flow of fuel-mixture as in sub-steps G and H. This may be done to certain degree for any particular mass ratio of water to fuel because of the width of the combustion envelope for the combustor using this particular fuel-mixture (see FIGS. 15–17). If, however, the injectivity decrease is substantial, a change also may be required in the mass ratio of the fuel-mixture in order to combust within the operable linear velocities for the combustor at the new injectivity pressure requirements. In this instance, a lower mass ratio of water to fuel in the fuel-mixture would be expected in order to maintain substantially the same heat release rate into the formation at a lower pressure and, as a result, a greater relative amount of injection water may be needed in order to maintain the exhaust temperature $T_{3a}$ at the desired set point temperature $T_{3sp}$.

In accordance with the more detailed aspect of the present invention, a novel procedure is followed in starting the combustor 11 to bring the catalyst 12 up to a temperature at which catalytic combustion of the burn-mixture may take place. For this purpose, while applying electrical energy to heat the nichrome heating element 58, a thermally combustible start fuel is supplied to the inlet chamber 24 of the combustor and is ignited to bring the catalyst temperature up to its light-off temperature. Herein, the start fuel is a graded fuel including a first portion which has a low auto ignition temperature (steps 14 through 18) followed by an intermediate portion (step 19) having a higher combustion temperature and finally by the burn-mixture (steps 19 and 20) to be combusted normally in the combustor.

Specifically methanol is contemplated as comprising the first portion of the start fuel. Methanol has an auto-ignition temperature of 878° F. Other suitable low auto-ignition temperature fuels that may be used in the first portion of the start fuel include diethyl ether which has an auto-igniting temperature of 366° F.; normal octane, auto-ignition temperature of 464° F.; 1-tetradecene, autoignition temperature of 463° F.; 2-methyl-octane autoignition temperature of 440° F.; or 2-methyl-nonane which has an auto-ignition temperature of 418° F. The intermediate portion of the start fuel is contemplated as being a diesel fuel or other heavy hydrocarbon liquid and a mixture of the start fuel and the fuel-mixture to be combusted. During start-up, the first portion of the graded start up fuel may be burnt thermally to both heat the catalyst 12 and to provide some recirculating heat for preheating the subsequent fuel. As the outlet temperature $T_2$ of the catalyst reaches the lower limit of the combustion range for the catalyst, the light-off temperature of the catalyst will be surpassed and the burn-mixture may be phased into the combustor for normal steady state combustion.

As shown in FIG. 1, a start fuel pump 91 is connected by a branch line 93 to the inlet line 19 of the combustor 11 to deliver the start fuel to the combustor upon start up. A valve 94 in the branch line is selectively closed and opened to regulate the flow of start fuel into the branch line as may be desired during the start up and shut down of the system. Preferably, operation of the heating element 58 is controlled through the computer 27 so as to be lit during start up as long as the temperature, $T_1$, in the inlet chamber 24, is below the auto-ignition temperature of methanol.

Figure 5:
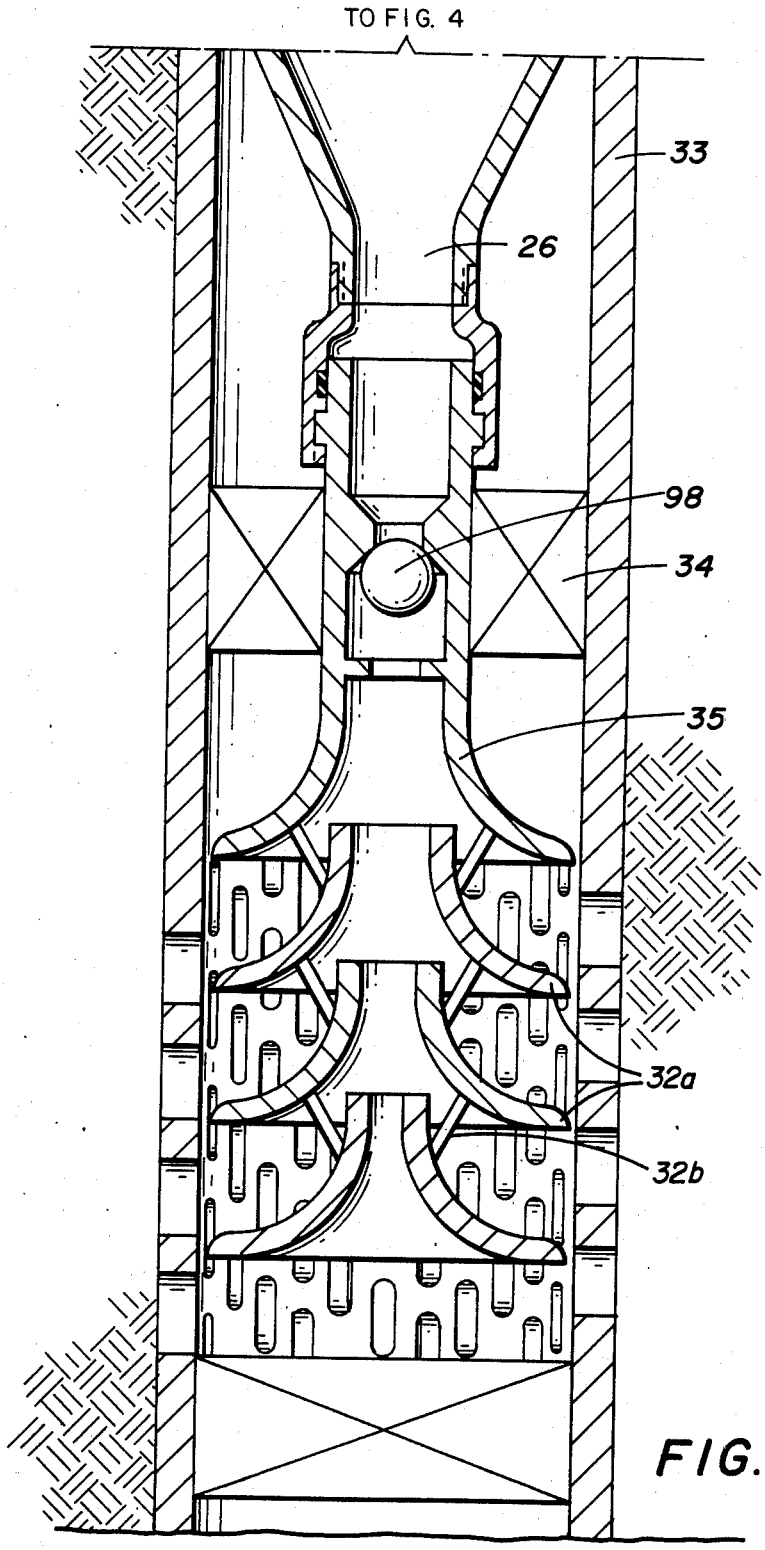
Figure 10:
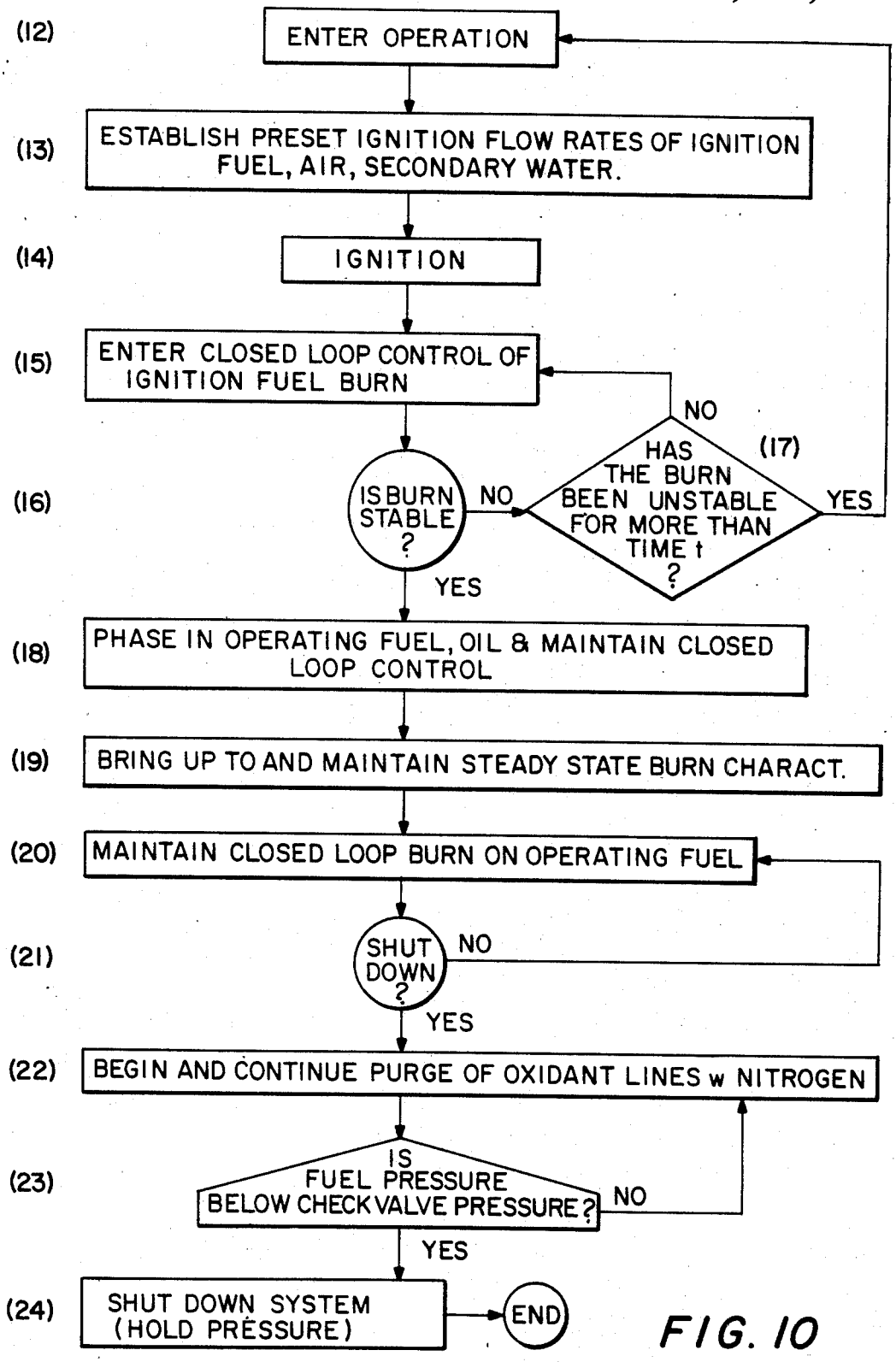

In shutting down the exemplary combustion system 10, a special sequence of steps is followed to protect the catalyst 12 against thermal shock and to keep it dry for restarting (see FIG. 10 steps 22 through 24). Accordingly, when shutting down the system, the flow volumes of fuel and air are maintained in stoichiometric quantities while a higher concentration of water to fuel is fed into the emulsion ultimately reducing the temperature $T_1$ in the inlet chamber 24 to approximately the light-off temperature for the catalyst. Upon reaching this light-off temperature, the flow of emulsion is reduced along with a proportional reduction in air so as to maintain stoichiometry. As the air is reduced in volume, a like volume of nitrogen from a source 96 is introduced into the line 20 through a valve 92 until the pressure in the fuel mixture line 19 drops below the check valve pressure causing the check valve 66 to close. At this point, nitrogen is substituted completely for the air and pressure in the line 20 is maintained so as to drive all of the burn-mixture in the inlet chamber 24 past the catalyst 12. As the burn-mixture is expelled, the outlet temperature of the catalyst $T_2$ will begin to drop and, as it drops, the amount of injection water is reduced proportionally. Ultimately, the injection water is shut-off when $T_2$ equals the desired combustor discharge temperature $T_{3sp}$. Preferably, in the downhole version, pressure downstream of the combustor is maintained by a check valve 98 (see FIG. 5) above the nozzle 32 so as to prevent well fluids from entering the combustor 11 after shut down.

Advantageously, for restarting purposes, a start plug of diethyl ether or methanol may be injected into the fuel line 19 at an appropriate stage in the shut down procedure so that a portion of this start plug passes the check valve 66 at the inlet to the combustor 11. If this latter step is followed, the inlet temperature $T_1$ may increase suddenly as a portion of the start plug enters the inlet chamber 24. By stopping flow of the fluid in the fuel line 19 with this sudden increase in temperature, the catalyst may be easily restarted with the portion of the plug remaining above the check valve.

In view of the foregoing, it will be appreciated that the present invention brings to the art a new and particularly useful combustion system 10 including a novel combustor 11 adapted for operation in a unique fashion to produce a heated working fluid. Advantageously, the working fluid may be produced efficiently over a wide range of heat release rates, temperatures, and pressures so that the same combustor may be used for a wide range of applications such as in the steam flooding of oil bearing formations having widely different reservoir characteristics. To these ends, boilerless production of the working fluid is achieved by construction of the combustor with the catalyst 12 being used as the primary combustor. Advantageously, in using this combustor, the diluent is mixed in a controlled amount intimately with the fuel prior to combustion and thus serves to keep the combustor te–perature at a selectively regulated low temperature for efficient combustion. An additional selected quantity of diluent is injected into the heated fluid exiting the catalyst to cool the fluid to its useful temperature. From one use to the next or as changes in output requirements develop, the flow of diluent, fuel and air may be regulated so as to produce the characteristics desired in the discharge fluid of the combustor.

The embodiments of the invention in which an exclusive property or privilege is claimed are defined as follows:

1. An admixture for burning in the presence of a catalyst having upper and lower stability limit temperatures substantailly defining an operating temperature range for the catalyst, said admixture upon introduction to the catalyst comprising, oxidant and fuel components present in substantially stoichiometric quantites relative to each other, and a substantially non-conbustible major diluent component comprised of at least one of a substance selected from the group consisting of $H_2O$, $CO_2$, $N_2$ and $SO_2$, said diluent component having a mass ratio relative to said fuel component generally within the range of 5.7:1 to 26.2:1, said components having a thermodynamic temperature equilibrium not substantially less than said lower stability temperature so that said burn-mixture combusts in the presence of the catalyst with an adiabatic combustion temperature within said operating temperature range so as to directly heat said diluent and minor fluid components and thereby to produce a heated working fluid, wherein the adiabatic combustion temperature is the highest possible combustion temperature obtained under conditions that burning occurs in an adiabatic vessel, that burning is complete, and that dissociation does not occur.

2. An admixture as defined by claim 1 including first portions of said major diluent and minor fluid components derived from some of the heated working fluid of a previously combusted mixture so that when admixed with the other portions of said burn-mixture components said components are heated at least substantially to said lower stability limit temperature.

3. An admixture as defined by claim 2 wherein air provides said oxidant and from 30 to 150% of the heated working fluid by weight relative to said air is used to provide said first portions of said major diluent and minor fluid components.

4. An admixture as defined by claim 1 wherein said fuel is a carbonaceous fuel and a second portion of said major diluent is derived from a pumpable liquid formed with liquid water as a continuous phase and said carbonaceous fuel as a disperse phase in a mass ratio of water to carbonaceous fuel of substantially 1.5:1 to 5.5:1 by weight.

5. An admixture as defined by claim 2 wherein said first portion of said diluent comprises between 40 to 94% by weight of the total amount of said diluent, and at least a part of said diluent is derived from liquid water.

6. An admixture as defined by claim 3 wherein said fuel is a carbonaceous fuel and a second portion of said major diluent is derived from a pumpable liquid formed with liquid water as a continuous phase and said carbonaceous fuel as a disperse phase in a mass ratio of water to carbonaceous fuel of substantially 1.5:1 to 5.5:1 by weight.

7. An admixture as defined by claim 6 wherein said carbonaceous fuel is in the form of particles no greater than 40 microns in diameter.

8. An admixture as defined by claim 6 wherein said pumpable liquid is an emulsion formed of liquid and heavy crude oil, admixed together with the emulsion being substantially neutralized from an acidic condition by the addition of an organic base to enhance emulsification.

9. An admixture combustible in the presence of a combustion catalyst having upper and lower stability limit temperatures substantially defining an operating temperature range for the catalyst, said admixture upon introduction to the catalyst comprising, oxidant and fuel components present in substantially stoichiometric quantitites relative to each other, and a substantially non-combustible major diluent component comprised of at least one substance selected from the group consisting of $H_2O$, $CO_2$, $N_2$ and $SO_2$, said admixture components having a mixture temperature not less than said lower stability limit temperature, and said diluent component having a mass ratio relative to said fuel component so that in the presence of the catalyst said oxidant and fuel components burn at an adiabatic combustion temperature within said operating temperature range to produce a heated working fluid, wherein the adiabatic combustion temperature is the highest possible combustion temperature obtained under conditions that burning occurs in an adiabatic vessel, that burning is complete, and that dissociation does not occur.

10. A burn-mixture for combustion in the presence of a catalyst having upper and lower stability limit temperatures substantially defining an operating range for the catalyst, said burn-mixture comprising oxident and fuel components present in substantially stoichiometric quantities relative to each other, and a substantially non-combustible major diluent component comprised of at least one substance selected from the group consisting of $H_2O$, $CO_2$, $N_2$ and $SO_2$, said diluent component including one portion taken in an amount from combustion products of a mixture previously combusted for the thermodynamic equilibrium temperature of said burn-mixture upon introduction to the catalyst to be such that said burn-mixture combusts at an adiabatic combustion temperature within said operating range of the catalyst, wherein the adiabatic combustion temperature is the highest possible combustion temperature obtained under conditions that burning occurs in an adiabatic vessel, that burning is complete, and that dissociation does not occur.

11. A burn-mixture for combustion in the presence of a catalyst having upper and lower stability limit temperatures substantially defining an operating range for the catalyst, said burn-mixture comprising, an air component, a fuel component selected from at least one of the group consisting of a distillate fuel, crude oil, and hydrogen with said fuel component being present in a substantailly stoichiometric quantity relative to oxygen in said air, and a substantially non-combustible major diluent component comprised of at least one substantce selected from the group consisting of $H_2O$, $CO_2$, $N_2$ and $SO_2$, said diluent component including one portion taken from combustion products of a mixture previously combusted in an amount within a range generally between 30 to 150% by weight relative to said air component for the thermodynamic equilibrium temperature of said burn-mixture upon introduction to the catalyst to be such that said burn-mixture combusts at an adiabatic combustion temperature within said operating range of the catalyst, wherein the adiabatic combustion temperature is the highest possible combustion temperature obtained under conditions that burning occurs in an adiabatic vessel, that burning is complete, and that dissociation does not occur.

12. A burn-mixture for combustion in the presence of a catalyst having upper and lower stability limit temperatures substantially defining an operating range for the catalyst, said burn-mixture comprising an air component, a fuel component selected from at least one of the group consisting of a distillate fuel, crude oil and hydrogen with said fuel component being present in a substantially stoichiometric quantity relative to oxygen in said air, and a substantially non-combustible major diluent component comprised of at least one substantce selected from the group consisting of $H_2O$, $CO_2$, $N_2$ and $SO_2$, said burn-mixture being heated by combustion products of a mixture previously combusted to a thermodynamic equilibrium temperature for said burn-mixture to combust at an adiabatic combustion temperature within said operating range of the catalyst, wherein the adiabatic combustion temperature is the highest possible combustion temperature obtained under conditions that burning occurs in an adiabatic vessel, that burning is complete, and that dissociation does not occur.

13. A burn-mixture for combustion in the presence of a catalyst having upper and lower stability limit temperatures substantially defining an operating range for the catalyst, said burn mixture comprising an air component, a fuel component comprised of diesel fuel present in a substantially stoichiometric quantity relative to oxygen in said air, and a substantially non-combustible major diluent component comprised of at least one substance selected from the group consisting of $H_2O$, $CO_2$, $N_2$ and $SO_2$, said diluent component including one portion taken from combustion products of a mixture as previously combusted in the combustor in an amount within a range generally between 25 to 150% by weight relative to said air component for the thermodynamic equilibrium temperature of said burn-mixture upon introduction to the catalyst to be such that said burn-mixture combusts at an adiabatic combustion temperature within said operating range of the catalyst, wherein the adiabatic combustion temperature is the highest possible combustion temperature obtained under conditions that burning occurs in an adiabatic vessel, that burning is complete, and that dissociation does not occur.

14. A burn-mixture for combustion in the presence of a catalyst having upper and lower stability limit temperatures substantailly defining an operating range for the catalyst, said burn-mixture comprising an air component, a fuel component comprised of crude oil present in a substantially stoichiometric quantity relative to oxygen in said air, and a substantially non-combustible major diluent component comprised of at least one substance selected from the group consisting of $H_2O$, $CO_2$, $N_2$ and $SO_2$, said diluent component including one portion taken from combustion products of a mixture as previously combusted in the combustor in an amount within a range generally between 30 to 150% by weight relative to said air component for the thermodynamic equilibrium temperature of said burn-mixture upon introduction to the catalyst to be such that said burn-mixture combusts at an adiabatic combustion temperature within said operating range of the catalyst, wherein the adiabatic combustion temperature is the highest possible combustion temperature obtained under conditions that burning occurs in an adiabatic vessel, that burning is complete, and that dissociation does not occur.

15. A burn-mixture for combustion in the presence of a catalyst having upper and lower stability limit temperatures substantially defining an operating range for the catalyst, said burn-mixture comprising an air component, a fuel component comprised of hydrogen present in a substantially stoichiometric quantity relative to oxygen in said air, and a substantially non-combustible major diluent component comprised of at least one substance selected from the group consisting of $H_2O$, $CO_2$, $N_2$ and $SO_2$, said diluent component including one portion taken from combustion products of a mixture previously combusted in an amount within a range generally between 80 to 150% by weight relative to said air component for the thermodynamic equilibrium temperature of said burn-mixture upon introduction to the catalyst to be such that said burn-mixture combusts at an adiabatic combustion temperature within said operating range of the catalyst, wherein the adiabatic combustion temperature is the highest possible combustion temperature obtained under conditions that burning occurs in an adiabatic vessel, that burning is complete, and that dissociation does not occur.

16. A burn-mixture for combustion in the presence of a catalyst having upper and lower stability limit temperatures substantailly defining an operating range for the catalyst, said burn-mixture comprising oxidant and carbonaceous fuel components present in substantially stoichiometric quantities relative to each other, and a substantially non-combustible major diluent component comprised of at least one substance selected from the group consisting of $H_2O$, $CO_2$, $N_2$ and $SO_2$, said diluent component including one portion taken in an amount from combustion products of a mixture previously combusted for the thermodynamic equilibrium temperature of said burn-mixture upon introduction to the catalyst to be such that said burn-mixture combusts at an adiabatic combustion temperature within said operating range of the catalyst, and said diluent component including another portion taken from an emulsion containing said fuel component and $H_2O$ in amount whereby the mass ratio of $H_2O$ relative to said fuel is generally defined by the range of 1.5:1 through 5.5:1, wherein the adiabatic combustion temperature is the highest possible combustion temperature obtained under conditions that burning occurs in an adiabatic vessel, that burning is complete, and that dissociation does not occur.

17. An admixture for burning in the presence of a catalyst having upper and lower stability limit temperatures substantially defining an operating temperature range for the catalyst, said admixture upon introduction to the catalyst comprising, oxidant and fuel components present in substantially stoichiometric quantities relative to each other, and a substantially non-combustible major diluent component comprised of at least one of a substance selected from the group consisting of $H_2O$, $CO_2$, $N_2$, and $SO_2$, said diluent component having a mass ratio relative to said fuel component generally within the range of 5.7:1 to 26.2:1 said components having a thermodynamic temperature equilibrium not substantailly less than said lower stability temperature so that said burn-mixture combusts in the presence of the catalyst with an adiabatic combustion temperature within said operating temperature range so as to directly heat said diluent and minor fluid components and thereby to produce a heated working fluid, and wherein first portions of said major diluent and minor fluid components are derived from some of the heated working fluid of a previously combusted mixture so that when admixed with the other portions of said burn-mixture components said components are heated at least substantially to said lower stability limit temperature, air provides said oxidant, from 30 to 150% of the heated working fluid by weight relative to said air is used to provide said first portions of said major diluent and minor fluid components, said fuel is a carbonaceous fuel, a second portion of said major diluent is derived from a pumpable liquid formed with liquid water as a continuous phase and said carbonaceous fuel as a disperse phase in a mass ratio of water to carbonaceous fuel of substantially 1.5:1 to 5.5:1 by weight, and wherein the adiabatic combustion temperature is the highest possible combustion temperature obtained under conditions that burning occurs in an adiabatic vessel, that burning is complete, and that dissociation does not occur.

* * * * *